US008042902B2

(12) United States Patent
Katada

(10) Patent No.: US 8,042,902 B2
(45) Date of Patent: Oct. 25, 2011

(54) PRESSURE ADJUSTMENT APPARATUS AND IMAGE FORMING APPARATUS, AND PRESSURE ADJUSTMENT METHOD AND LIQUID REMAINING AMOUNT DETERMINATION METHOD

(75) Inventor: Masahito Katada, Kanagawa-ken (JP)

(73) Assignee: Fujifilm Corporation, Tokyo (JP)

( * ) Notice: Subject to any disclaimer, the term of this patent is extended or adjusted under 35 U.S.C. 154(b) by 924 days.

(21) Appl. No.: 12/031,557

(22) Filed: Feb. 14, 2008

(65) Prior Publication Data

US 2008/0198207 A1 Aug. 21, 2008

(30) Foreign Application Priority Data

Feb. 16, 2007 (JP) ..... 2007-037016

(51) Int. Cl.
*B41J 29/38* (2006.01)

(52) U.S. Cl. ..... 347/17; 347/6; 347/7; 347/19; 347/85; 347/86

(58) Field of Classification Search ..... None
See application file for complete search history.

(56) References Cited

U.S. PATENT DOCUMENTS 7,296,881 B2 * 11/2007 Langford et al. ..... 347/84
7,524,044 B2 * 4/2009 Kumagai ..... 347/85
2006/0109321 A1 5/2006 Nottelman et al.

FOREIGN PATENT DOCUMENTS

JP 2006-150963 A 6/2006

* cited by examiner

*Primary Examiner* — Uyen Chau N Le
*Assistant Examiner* — Chad Smith
(74) *Attorney, Agent, or Firm* — Birch, Stewart, Kolasch & Birch, LLP

(57) ABSTRACT

A pressure adjustment apparatus for adjusting a pressure of liquid inside a liquid ejection head including nozzles and flow channels includes: a tank; a pump; a buffer chamber; a first switching device; and a second switching device. The tank includes a movable film and a hermetically sealed container of a prescribed volume, the movable film dividing the hermetically sealed container into a gas chamber filled with gas and a liquid chamber filled with the liquid to be supplied to the liquid ejection head. The pump changes a pressure of the gas inside the gas chamber so as to adjust a pressure of the liquid inside the liquid chamber. The buffer chamber is filled with the gas and damps gas-flow pulsations caused by the pump. The first switching device connects and disconnects the buffer chamber and the gas chamber. The second switching device switches between a state where the pump is connected to the gas chamber without through the buffer chamber, and a state where the pump is connected to the buffer chamber.

6 Claims, 15 Drawing Sheets

FIG.8

600

| PRESSURE RANGE P(M−1)~P(M) / VOLUME V(N) | P(0)~P(1) | P(1)~P(2) | P(2)~P(3) | ·· | P(Mmax−1)~P(Mmax) |
|---|---|---|---|---|---|
| V(1) | ΔP1(1,1) | ΔP1(2,1) | ΔP1(3,1) | ·· | ΔP1(Mmax,1) |
| V(2) | ΔP1(1,2) | ΔP1(2,2) | ΔP1(3,2) | ·· | ΔP1(Mmax,2) |
| V(3) | ΔP1(1,3) | ΔP1(2,3) | ΔP1(3,3) | ·· | ΔP1(Mmax,3) |
| ⋮ | ⋮ | ⋮ | ⋮ | ⋮ | ⋮ |
| V(Nmax) | ΔP1(1,Nmax) | ΔP1(2,Nmax) | ΔP1(3,Nmax) | ·· | ΔP1(Mmax,Nmax) |

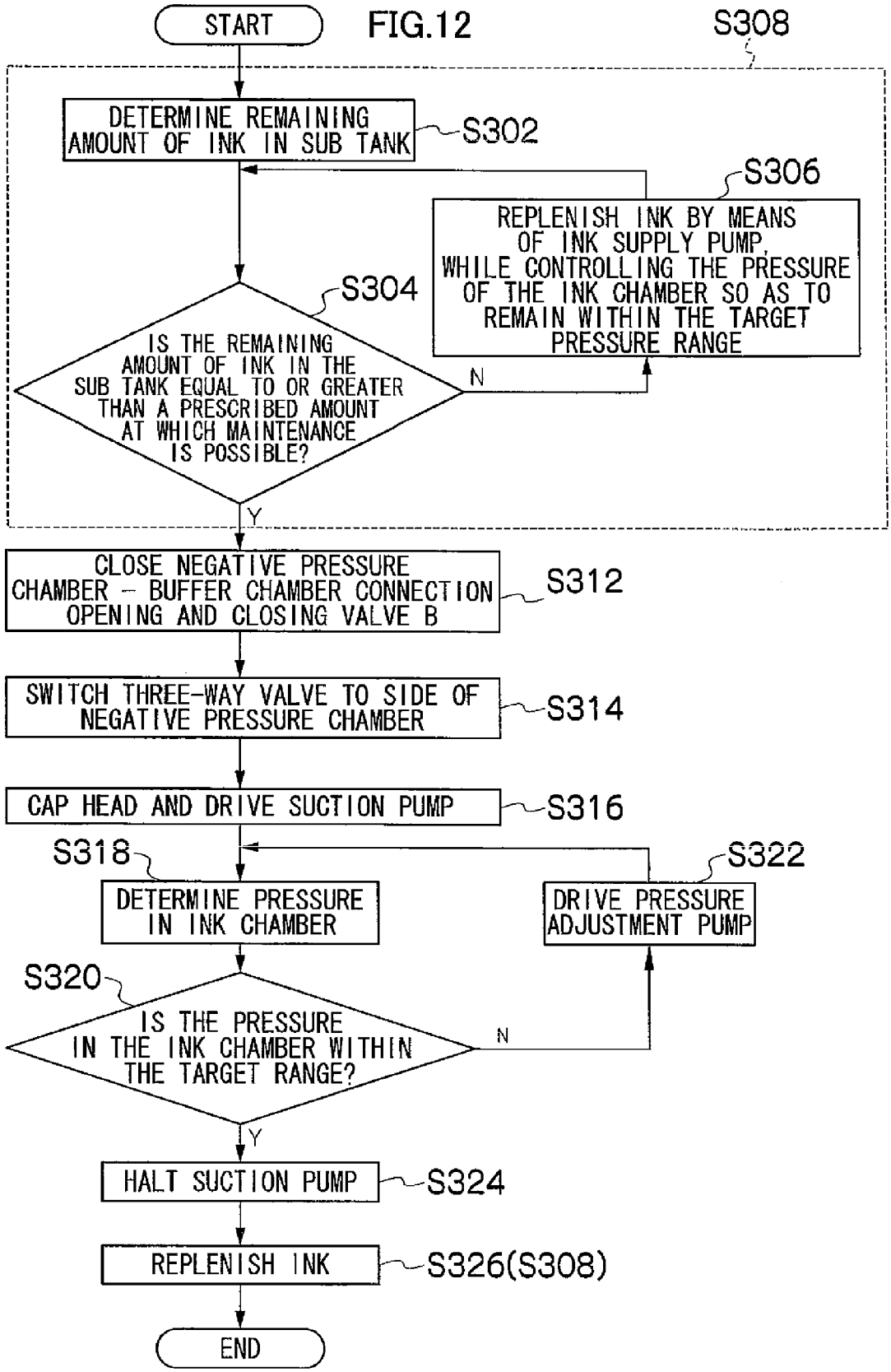
START
FIG.12
S308
DETERMINE REMAINING AMOUNT OF INK IN SUB TANK
S302
S306
REPLENISH INK BY MEANS OF INK SUPPLY PUMP, WHILE CONTROLLING THE PRESSURE OF THE INK CHAMBER SO AS TO REMAIN WITHIN THE TARGET PRESSURE RANGE
S304
IS THE REMAINING AMOUNT OF INK IN THE SUB TANK EQUAL TO OR GREATER THAN A PRESCRIBED AMOUNT AT WHICH MAINTENANCE IS POSSIBLE?
N
Y
CLOSE NEGATIVE PRESSURE CHAMBER - BUFFER CHAMBER CONNECTION OPENING AND CLOSING VALVE B
S312
SWITCH THREE-WAY VALVE TO SIDE OF NEGATIVE PRESSURE CHAMBER
S314
CAP HEAD AND DRIVE SUCTION PUMP
S316
S318
S322
DETERMINE PRESSURE IN INK CHAMBER
DRIVE PRESSURE ADJUSTMENT PUMP
S320
IS THE PRESSURE IN THE INK CHAMBER WITHIN THE TARGET RANGE?
N
Y
HALT SUCTION PUMP
S324
REPLENISH INK
S326(S308)
END

PRESSURE ADJUSTMENT APPARATUS AND IMAGE FORMING APPARATUS, AND PRESSURE ADJUSTMENT METHOD AND LIQUID REMAINING AMOUNT DETERMINATION METHOD

BACKGROUND OF THE INVENTION

1. Field of the Invention

The present invention relates to a pressure adjustment apparatus provided with a buffer chamber for damping a pulsating flow generated by a pump which adjusts the back pressure in a liquid ejection head, and to an image forming apparatus provided with this pressure adjustment apparatus, a pressure adjustment method for adjusting the back pressure in a liquid ejection head, and a liquid remaining amount determination method which is based on the adjustment of back pressure in a liquid ejection head.

2. Description of the Related Art

An inkjet printer has been known which includes a plurality of nozzles which eject ink, a plurality of pressure chambers which are connected respectively to the plurality of nozzles, and a common flow channel for supplying ink to the plurality of pressure chambers. In the liquid ejection head of this kind, in order to avoid leakage of ink from the nozzles, it is necessary to set the pressure in the flow channels inside the liquid ejection head (and more specifically, the pressure inside the pressure chambers and the pressure inside the common flow channel) to a pressure that is lower than the atmospheric pressure. Moreover, if the pressure in the flow channels inside the liquid ejection head varies, then this affects the liquid droplet generating process, which in turn affects the quality of the image formed on the ejection receiving medium. Therefore, it is preferable to maintain a uniform pressure differential between the pressure in the flow channels of the liquid ejection head, and the atmospheric pressure.

Japanese Patent Application Publication No. 2006-150963 discloses a durable and relatively simple pressure adjustment apparatus for adjusting the pressure in the flow channels inside a liquid ejection head in which a membrane pump for pressure adjustment is provided, and a buffer tank for reducing the pulsating flow generated by the pump is provided in the ink tube between this pump and the liquid ejection head.

However, since the buffer tank provided in the ink tube between the pump and the liquid ejection head generally has a large volume, then it takes time until the pressure inside the liquid ejection head reaches a prescribed negative pressure which is lower than the atmospheric pressure. If it takes time to establish the back pressure (a negative pressure which is lower than the atmospheric pressure) in the liquid ejection head in this way, then the standby time until the start of a printing operation becomes longer, and therefore the printing productivity declines.

SUMMARY OF THE INVENTION

The present invention has been contrived in view of these circumstances, an object thereof being to provide a pressure adjustment apparatus which is able to reduce the pulsating flow generated by a pump that adjusts the back pressure of a liquid ejection head, while also being able to shorten the time required until the pressure inside the liquid ejection head is set to a specified negative pressure, and to provide an image forming apparatus comprising this pressure adjustment apparatus, a pressure adjustment method for adjusting the back pressure in a liquid ejection head, and a remaining amount of liquid determination method which utilizes this pressure adjustment.

In order to attain the aforementioned object, the present invention is directed to a pressure adjustment apparatus which adjusts a pressure of liquid inside a liquid ejection head including nozzles and flow channels, the pressure adjustment apparatus comprising: a tank which includes a movable film and a hermetically sealed container of a prescribed volume, the movable film dividing the hermetically sealed container into a gas chamber filled with gas and a liquid chamber filled with the liquid to be supplied to the liquid ejection head; a pump which changes a pressure of the gas inside the gas chamber so as to adjust a pressure of the liquid inside the liquid chamber; a buffer chamber which is filled with the gas and which damps gas-flow pulsations caused by the pump; a first switching device which connects and disconnects the buffer chamber and the gas chamber; and a second switching device which switches between a state where the pump is connected to the gas chamber without through the buffer chamber, and a state where the pump is connected to the buffer chamber.

In this aspect of the present invention, it is possible to reduce the pulsating flow generated by the pump which adjusts the back pressure of the liquid ejection head, and to switch between the state where the pump is connected to the gas chamber of the tank without passing via the buffer chamber and the state where the pump is connected to the gas chamber of the tank via the buffer chamber, and therefore it is possible to shorten the time (back pressure start up time) until the back pressure of the liquid ejection head is initialized or reset to a specified negative pressure which is lower than the atmospheric pressure. Consequently, the standby time until the start of a printing operation is shortened, and the printing productivity is improved. Moreover, after setting the negative pressure, it is possible to adjust the pressure of the buffer chamber in a state where the connection between the buffer chamber and the gas chamber of the tank is shut off, and therefore, it is also possible to start a printing operation even during pressure adjustment of the buffer chamber.

Preferably, the pressure adjustment apparatus further includes a control device which controls the first and second switching devices and the pump, the control device adjusts the pressure of the liquid inside the liquid chamber with the pump in a state where the first switching device disconnects the buffer chamber from the gas chamber and the second switching device connects the pump to the gas chamber without through the buffer chamber, then the control device adjusts a pressure of the gas inside the buffer chamber with the pump in a state where the second switching device connects the pump to the buffer chamber, and then the control device adjusts the pressure of the liquid inside the liquid chamber through the buffer chamber with the pump in a state where the first switching device connects the buffer chamber to the gas chamber and the second switching device connects the pump to the buffer chamber.

Preferably, when suction maintenance for the liquid ejection head is performed to suction the liquid from a liquid ejection surface of the liquid ejection head, the control device adjusts the pressure of the liquid inside the liquid chamber with the pump in the state where the first switching device disconnects the buffer chamber from the gas chamber and the second switching device connects the pump to the gas chamber without through the buffer chamber.

When carrying out so-called suction maintenance by means of a liquid collection pump, or the like, the back pressure of the liquid ejection head is liable to change suddenly. In the above aspects of the present invention, the pressure is, however, adjusted without the use of the buffer chamber during suction maintenance, and therefore it is possible for the adjustment of the back pressure to respond rapidly to the change in the back pressure caused by the suction maintenance.

Preferably, the pressure adjustment apparatus further includes: a pressure determination device which determines the pressure of the gas inside the gas chamber; and a liquid remaining amount determination device which determines a remaining amount of the liquid inside the liquid chamber by determining a volume of the gas chamber according to an amplitude of pulsation component in a pressure change determined in the pressure of the gas inside the gas chamber by the pressure determination device during pressure adjustment not using the buffer chamber.

In this aspect of the present invention, it is possible to determine the remaining amount of ink by utilizing the pulsating flow during pressure adjustment (pressure adjustment without the use of the buffer chamber) which is not performed via the buffer chamber, without providing a separate sensor for measuring the remaining amount of ink.

Preferably, the pressure adjustment apparatus further includes: a pressure determination device which determines the pressure of the gas inside the gas chamber; and a liquid remaining amount determination device which determines a remaining amount of the liquid inside the liquid chamber by determining a volume of the gas chamber according to an amplitude of pulsation component in a pressure change determined in the pressure of the gas inside the gas chamber by the pressure determination device during pressure adjustment not using the buffer chamber, and an amplitude of pulsation component in a pressure change determined in the pressure of the gas inside the gas chamber by the pressure determination device during pressure adjustment using the buffer chamber.

In this aspect of the present invention, it is possible to determine the remaining amount of ink without providing a separate sensor for measuring the remaining amount of ink, and furthermore it is also possible to improve the accuracy of the determination of the remaining amount of ink, by utilizing both the pulsating flow during pressure adjustment (pressure adjustment without the use of the buffer chamber) which does not pass via the buffer chamber, and the pulsating flow during pressure adjustment (pressure adjustment with the use of the buffer chamber) via the buffer chamber.

In order to attain the aforementioned object, the present invention is also directed to an image forming apparatus comprising the above-described pressure adjustment apparatus.

In order to attain the aforementioned object, the present invention is also directed to a pressure adjustment method for adjusting a pressure of liquid inside a liquid ejection head by means of a pressure adjustment apparatus which comprises: a tank which includes a movable film and a hermetically sealed container of a prescribed volume, the movable film dividing the hermetically sealed container into a gas chamber filled with gas and a liquid chamber filled with the liquid to be supplied to the liquid ejection head; a pump which changes a pressure of the gas inside the gas chamber so as to adjust a pressure of the liquid inside the liquid chamber; and a buffer chamber which is filled with the gas and which damps gas-flow pulsations caused by the pump, the pressure adjustment method comprising: a first pressure adjusting step of adjusting the pressure of the liquid inside the liquid chamber with the pump in a state where the buffer chamber is disconnected from the gas chamber and the pump is connected to the gas chamber without through the buffer chamber; a second pressure adjusting step of adjusting a pressure of the gas inside the buffer chamber with the pump in a state where the pump is connected to the buffer chamber; and a third pressure adjusting step of adjusting the pressure of the liquid inside the liquid chamber through the buffer chamber with the pump in a state where the buffer chamber is connected to the gas chamber and the pump is connected to the buffer chamber.

Preferably, the pressure adjustment method further includes a fourth pressure adjusting step of adjusting the pressure of the liquid inside the liquid chamber with the pump in the state where the buffer chamber is disconnected from the gas chamber and the pump is connected to the gas chamber without through the buffer chamber, when suction maintenance for the liquid ejection head is performed to suction the liquid from a liquid ejection surface of the liquid ejection head.

In order to attain the aforementioned object, the present invention is also directed to a liquid remaining amount determination method for determining a remaining amount of liquid inside a liquid chamber of a pressure adjustment apparatus which adjusts a pressure of the liquid inside a liquid ejection head and comprises: a tank which includes a movable film and a hermetically sealed container of a prescribed volume, the movable film dividing the hermetically sealed container into a gas chamber filled with gas and the liquid chamber filled with the liquid to be supplied to the liquid ejection head; a pump which changes a pressure of the gas inside the gas chamber so as to adjust a pressure of the liquid inside the liquid chamber; and a buffer chamber which is filled with the gas and which damps gas-flow pulsations caused by the pump, the liquid remaining amount determination method comprising the steps of: determining an amplitude of pulsation component in a pressure change in the gas inside the gas chamber during pressure adjustment not using the buffer chamber; and determining the remaining amount of the liquid inside the liquid chamber by determining a volume of the gas chamber according to the determined amplitude of the pulsation component.

In order to attain the aforementioned object, the present invention is also directed to a liquid remaining amount determination method for determining a remaining amount of liquid inside a liquid chamber of a pressure adjustment apparatus which adjusts a pressure of the liquid inside a liquid ejection head and comprises: a tank which includes a movable film and a hermetically sealed container of a prescribed volume, the movable film dividing the hermetically sealed container into a gas chamber filled with gas and the liquid chamber filled with the liquid to be supplied to the liquid ejection head; a pump which changes a pressure of the gas inside the gas chamber so as to adjust a pressure of the liquid inside the liquid chamber; and a buffer chamber which is filled with the gas and which damps gas-flow pulsations caused by the pump, the liquid remaining amount determination method comprising the steps of: determining a first amplitude of pulsation component in a pressure change in the gas inside the gas chamber during pressure adjustment not using the buffer chamber; determining a second amplitude of pulsation component in a pressure change in the gas inside the gas chamber during pressure adjustment using the buffer chamber; and determining the remaining amount of the liquid inside the liquid chamber by determining a volume of the gas chamber according to the first and second amplitudes of the pulsation components.

According to the present invention, the pulsating flow (gas flow pulsations) generated from a pump which adjusts the back pressure of a liquid ejection head is reduced, and furthermore, the time required for the pressure in the liquid ejection head to reach a specified negative pressure can be shortened.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 8 is a diagram showing one example of correlation table showing the correspondences between the amplitude of the pressure oscillation due to the pulsating flow and the volume of the negative pressure chamber;

FIG. 12 is a flowchart showing a sequence of one example of a head suction maintenance process.

DETAILED DESCRIPTION OF THE PREFERRED EMBODIMENTS

Figure 1:
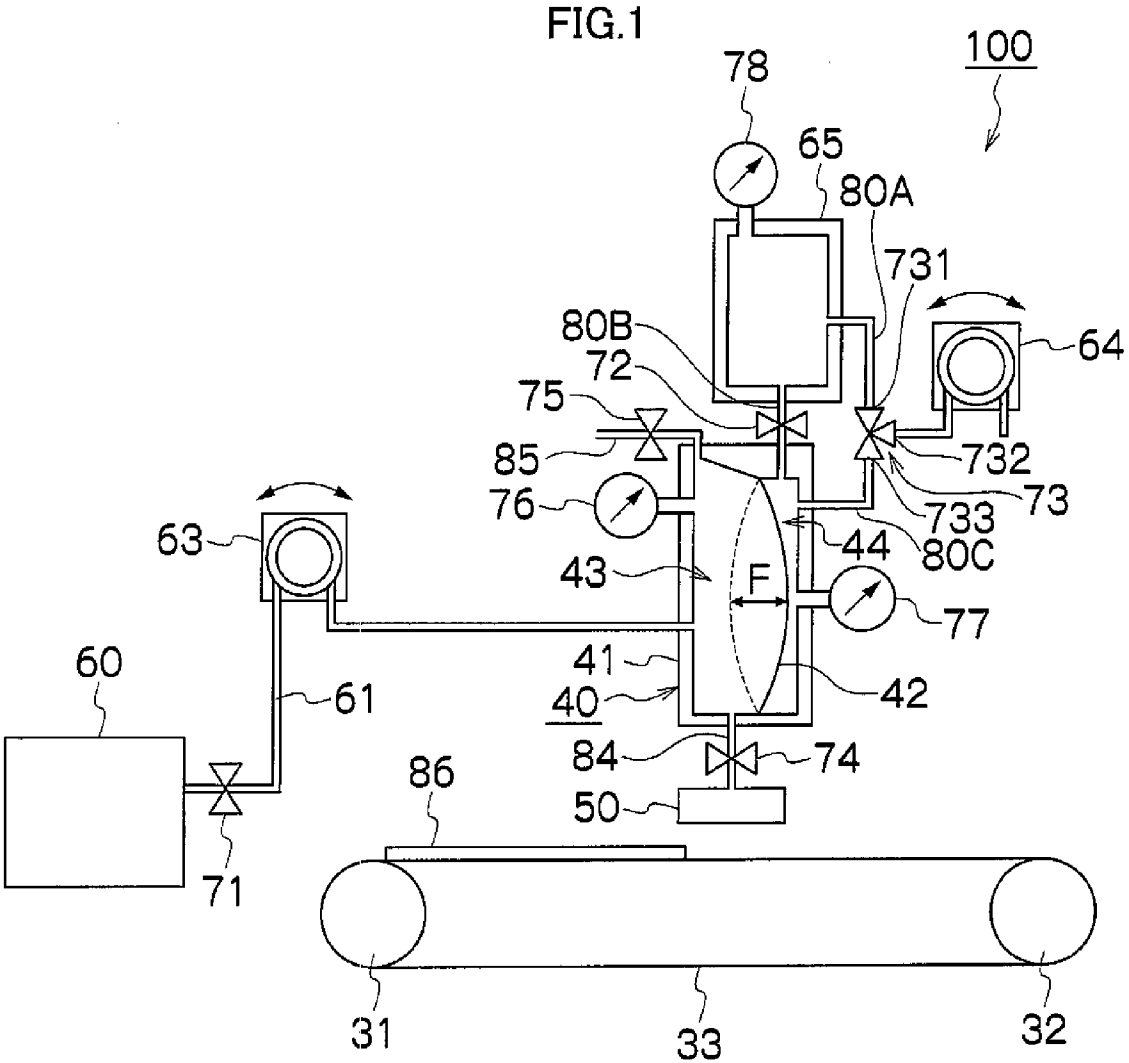
FIG. 1 is a schematic drawing showing the principal part of an image forming apparatus which includes a the pressure adjustment apparatus according to an embodiment of the present invention.

FIG. 1 is a schematic drawing showing the principal part of an image forming apparatus 100 (liquid droplet ejection apparatus) which is provided with a pressure adjustment apparatus according to an embodiment of the present invention.

In FIG. 1, the image forming apparatus 100 comprises a liquid ejection head 50 which ejects ink droplets, conveyance rollers 31 and 32, and a conveyance belt 33 which is set about the conveyance rollers 31 and 32. By ejecting ink droplets from the liquid ejection head 50 towards an ejection receiving medium 86 such as a paper which is conveyed on the conveyance belt 33, an image is formed on the ejection receiving medium 86.

The image forming apparatus 100 comprises a main tank 60 and a sub tank 40. The ink stored in the main tank 60 is supplied to the sub tank 40 via a first liquid supply flow channel 61 which leads from the main tank 60 to the sub tank 40. The ink stored temporarily in the sub tank 40 is then supplied to the liquid ejection head 50 via a second liquid supply flow channel 84 which leads from the sub tank 40 to the liquid ejection head 50.

An ink replenishment pump 63 and a tank connection opening and closing valve 71 which opens and closes the first liquid supply flow channel 61, are provided in the first liquid supply flow channel 61 which leads from the main tank 60 to the sub tank 40.

The sub tank 40 is constituted of a hermetically sealed container 41 (frame body) which has a fixed volume and includes a movable film 42. The movable film 42 divides the hermetically sealed container 41 into an ink chamber 43 (liquid chamber) which stores ink and a negative pressure chamber 44 (gas chamber) inside which a gas is enclosed. The ink chamber 43 of the sub tank 40 is connected to the liquid ejection head 50.

The movable film 42 of the sub tank 40 has flexibility and elastic properties, and is movable in the direction of arrow F in FIG. 1.

The container 41 forming the frame body of the sub tank 40 is rigid (not flexible) and has a uniform volume. In other words, the total volume of the ink chamber 43 and the negative pressure chamber 44 in the sub tank 40 is uniform. The volume of the negative pressure chamber 44 in the sub tank 40 is, for example, the minimum volume that is required for the movable film 42 to be movable at its maximum displacement.

The image forming apparatus 100 comprises a pressure adjustment pump 64 and a buffer chamber 65. The pressure adjustment pump 64 adjusts the pressure of the ink inside the ink chamber 43 of the sub tank 40 by adjusting the pressure of the gas inside the negative pressure chamber 44 of the sub tank 40. The pressure adjustment pump 64 is also used when adjusting the pressure of the gas inside the buffer chamber 65. The buffer chamber 65 is a chamber which has a prescribed volume for damping the pulsating flow generated by the pressure adjustment pump 64.

A tube pump, plunger pump, or the like, may be used as the pressure adjustment pump 64. The pulsating flow is generated when the pressure adjustment pump 64 is driven, but the amplitude of this pulsating flow is reduced by the buffer chamber 65 to a level which avoids any impairment of print quality.

A flow channel which is designated with the reference numeral 80A (hereinafter, referred to as "buffer chamber-pump connection channel") is provided between the buffer chamber 65 and the pressure adjustment pump 64, a flow channel which is designated with the reference numeral 80B (hereinafter, referred to as "negative pressure chamber-buffer chamber connection channel") is provided between the negative pressure chamber 44 and the buffer chamber 65 of the sub tank 40, and a flow channel which is designated with the reference numeral 80C (hereinafter, referred to as "negative pressure chamber-pump connection channel") is provided between the negative pressure chamber 44 and the pressure adjustment pump 64 of the sub tank 40.

Below, in order to simplify the description, the buffer chamber-pump connection channel 80A, the negative pressure chamber-buffer chamber connection channel 80B and the negative pressure chamber-pump connection channel 80C are referred to as "flow channel A", "flow channel B", and "flow channel C", respectively.

In the present embodiment, as shown in FIG. 1, a flow channel from the pressure adjustment pump 64 branches into the flow channel A (reference numeral 80A) between the pressure adjustment pump 64 and the buffer chamber 65, and the flow channel C (reference numeral 80C), at a three-way valve 73.

An opening and closing valve 72 (also referred to as "negative pressure chamber-buffer chamber connection opening and closing valve") which opens and closes the flows channel 80B is provided in the flow channel B (reference numeral 80B) between the negative pressure chamber 44 and the buffer chamber 65 in the sub tank 40.

The three-way valve 73 has three connection ports 731, 732 and 733, and the first connection port 731 is connected to the buffer chamber 65 via the flow channel A (reference numeral 80A), the second connection port 732 is connected to the pressure adjustment pump 64, and the third connection port 733 is connected to the negative pressure chamber 44 of the sub tank 40 via the flow channel C (reference numeral 80C). By means of this three-way valve 73, it is possible to connect the first connection port 731 and the second connection port 732, or to connect the second connection port 732 and the third connection port 733. The three-way valve 73 switches between a first connection state in which the pressure adjustment pump 64 is connected to the negative pressure chamber 44 of the sub tank 40 through the flow channel C (reference numeral 80C) without passing through the buffer chamber 65, and a second connection state in which the pressure adjustment pump 64 is connected to the buffer chamber 65 via the flow channel A (reference numeral 80A).

An opening and closing valve 74 (which is also called the "ink chamber-head connection opening and closing valve") which opens and closes the second liquid supply flow channel 84 leading from the sub tank 40 to the liquid ejection head 50 is provided in the second liquid supply flow channel 84.

A gas bubble expulsion flow channel 85 for expelling gas bubbles inside the ink chamber 43 is connected to the uppermost end of the ink chamber 43 in the sub tank 40. An opening and closing valve 75 (also referred to as the "gas bubble expulsion flow channel opening and closing valve") which opens and closes the gas bubble expulsion flow channel 85 is provided in the flow channel 85.

Below, in order to simplify the description, the tank connection opening and closing valve 71, the negative pressure chamber-buffer chamber connection opening and closing valve 72, the three-way valve 73, the ink chamber-head connection opening and closing valve 74, and the gas bubble expulsion flow channel opening and closing valve 75, are also referred to as "valve A", "valve B", "valve C", "valve D" and "valve E", respectively.

The ink chamber pressure determination unit 76 is a pressure sensor which determines the pressure of the ink inside the ink chamber 43 in the sub tank 40. The negative pressure chamber pressure determination unit 77 is a pressure sensor which determines the pressure of the gas inside the negative pressure chamber 44 in the sub tank 40. The buffer chamber pressure determination unit 78 is a pressure sensor which determines the pressure of the gas inside the buffer chamber 65. It is possible to use a commonly known pressure sensor for these pressure sensors.

Figure 2A:
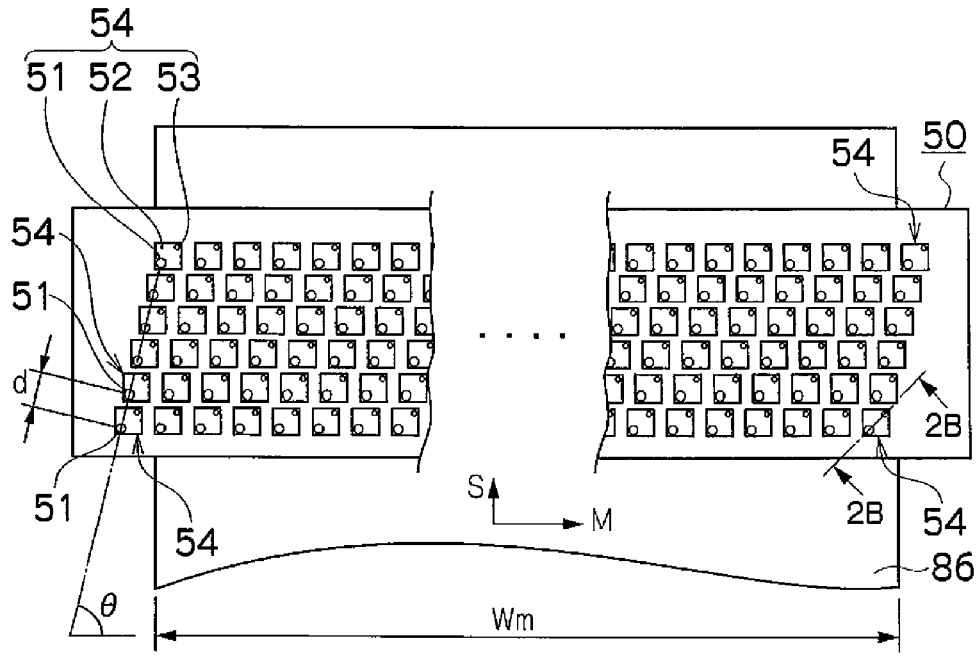
FIG. 2A is a plan view perspective diagram showing the general configuration of one example of a liquid ejection head.

FIG. 2A is a plan view perspective diagram showing a configuration example of the liquid ejection head 50.

Figure 2B:
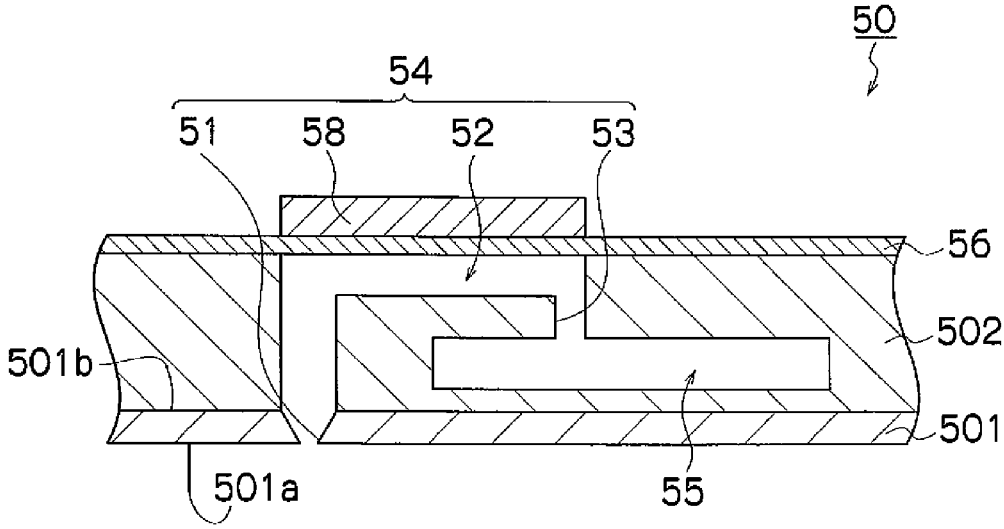
FIG. 2B is a cross-sectional diagram along section 2B-2B in FIG. 2A.

The liquid ejection head 50 shown as the configuration example in FIG. 2A is a so-called full line liquid ejection head, having a structure in which a plurality of nozzles 51 (liquid ejection ports) which eject droplets of ink toward a medium 86 are arranged in a two-dimensional configuration through a length corresponding to the width Wm of the ejection receiving medium 86 in the direction perpendicular to the direction of conveyance of the ejection receiving medium 86 (the sub-scanning direction indicated by arrow S in FIGS. 2A and 2B), in other words, in the main scanning direction indicated by arrow M in FIGS. 2A and 2B.

The liquid ejection head 50 comprises a plurality of liquid ejection elements 54, each comprising a nozzle 51 which ejects liquid, a pressure chamber 52 connected to a nozzle 51, and a liquid supply port 53 for supplying liquid to the pressure chamber 52, the recording elements 54 being arranged in two directions, namely, a main scanning direction M and an oblique direction forming a prescribed acute angle θ (where $0°<\theta<90°$) with respect to the main scanning direction M. In FIG. 2A, in order to simplify the drawing, only a portion of the liquid ejection elements 54 are depicted in the drawing.

In specific terms, the nozzles 51 are arranged at a uniform pitch d in the direction forming a prescribed acute angle of θ with respect to the main scanning direction M, and hence the nozzle arrangement can be treated as equivalent to a configuration in which nozzles are arranged at an interval of $d\times\cos\theta$ in a single straight line following the main scanning direction M.

Furthermore, FIG. 213 shows a cross-sectional diagram along line 2B-2B in FIG. 2A.

In FIG. 2B, the liquid ejection head 50 comprises nozzles 51 which eject liquid, pressure chambers 52 which are connected to the nozzles 51 and into which liquid is filled, liquid supply ports 53 for supplying liquid to the pressure chambers 52, a common flow channel 55 which is connected to the pressure chambers 52 via the liquid supply ports 53, and piezoelectric elements 58 which form actuators for changing the pressure inside the pressure chambers 22.

FIG. 2B shows only one liquid ejection element 54, in order to simplify the illustration, but the liquid ejection head 50 actually is constituted by a plurality of liquid ejection elements 54 which are arranged in a two-dimensional configuration as shown in FIG. 2A. More specifically each liquid ejection element 54 comprises one nozzle 51, one pressure chamber 52, one liquid supply port 53, and one piezoelectric element 58. In other words, in practice, the liquid ejection head 50 comprises a plurality of nozzles 51, a plurality of pressure chambers 52, a plurality of liquid supply ports 53 and a plurality of piezoelectric elements 58.

The liquid ejection head 50 is composed by bonding a nozzle plate 501 formed with nozzles 51 to a pressure chamber plate 502 in which pressure chambers 52 and the like are formed. In other words, one surface of the nozzle plate 501 forms a nozzle surface 501*a* (liquid ejection surface) in which nozzles 51 are arranged in a two-dimensional configuration as shown in FIG. 2A, and the other surface of the nozzle plate 501 forms a bonding surface 501*b* which is bonded to the pressure chamber plate 502.

Figure 3:
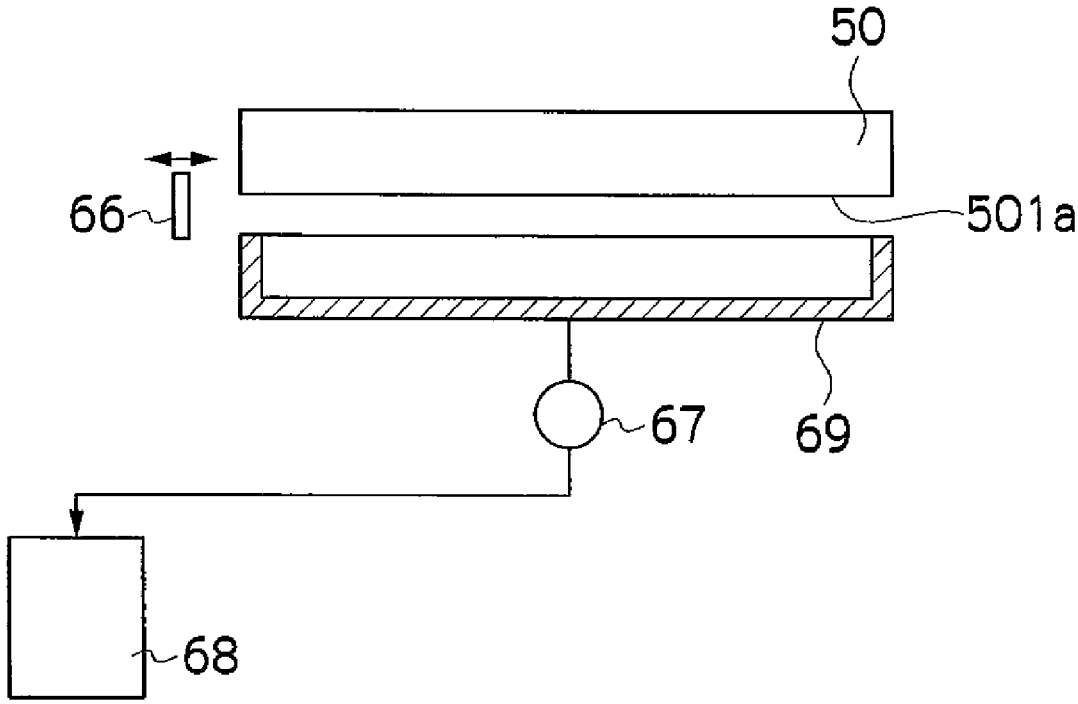
FIG. 3 is a general schematic drawing showing the composition of a maintenance system of an image forming apparatus.

FIG. 3 is an approximate compositional diagram which shows the composition of the maintenance system of the image forming apparatus 100 shown in FIG. 1.

In FIG. 3, the cap 69 is a device which prevents drying of the meniscus in the nozzles 51 or which prevents increase in the viscosity of the ink in the vicinity of the meniscus, during a prolonged idle period without performing ejection. The cleaning blade 66 is provided as a device for cleaning the nozzle surface 501*a*. A maintenance unit including the cap 69 and the cleaning blade 66 can be relatively moved with respect to the liquid ejection head 50 by a movement mechanism (not shown), and is moved from a predetermined holding position to a maintenance position below the liquid ejection head 50 as required. The cap 69 is displaced up and down relatively with respect to the liquid ejection head 50 by an elevator mechanism (not shown). The elevator mechanism is configured such that the cap 69 is raised to a predetermined elevated position so as to come into close contact with the liquid ejection head 50, and at least the nozzle area of the nozzle face 501*a* is thereby covered with the cap 69. Moreover, desirably, the inside of the cap 69 is divided by means of partitions into a plurality of areas corresponding to the nozzle rows, thereby achieving a composition in which suction can be performed selectively in each of the demarcated areas, by means of a selector, or the like.

The cleaning blade 66 is composed of rubber or another elastic member, and can slide on the nozzle face 501*a* of the liquid ejection head 50 by means of a movement mechanism for this cleaning blade (not shown). When ink droplets or foreign matter has adhered to the nozzle face 501*a*, the surface of the nozzle face 501 is wiped and cleaned by sliding the cleaning blade 66 on the nozzle face 501*a*.

A suction pump 67 suctions ink from the nozzles 51 of the liquid ejection head 50 and sends the suctioned ink to a recovery tank 68 in a state where the nozzle surface 501*a* of the liquid ejection head 50 is covered by the cap 69.

A suction operation of this kind is carried out when ink is filled into the liquid ejection head 50 from the main tank 60 when the main tank 60 is installed in the image forming apparatus 100 (initial filling), and it is also carried out when removing ink of increased viscosity after the apparatus has been out of use for a long period of time (start of use after long period of inactivity).

Furthermore, if air bubbles infiltrate inside the nozzles 51 and pressure chambers 52 of the liquid ejection head 50, or if the increase in the viscosity of the ink inside the nozzles 51 exceeds a certain level, then it becomes impossible to eject ink from the nozzles 51 in the aforementioned dummy ejection operation, and therefore, the cap 69 is abutted against the nozzle surface 501*a* of the liquid ejection head 50, and an operation is performed to suction out the ink containing air bubbles or the ink of increased viscosity inside the pressure chambers 52 of the liquid ejection head 50, by means of the suction pump 67.

Figure 4:
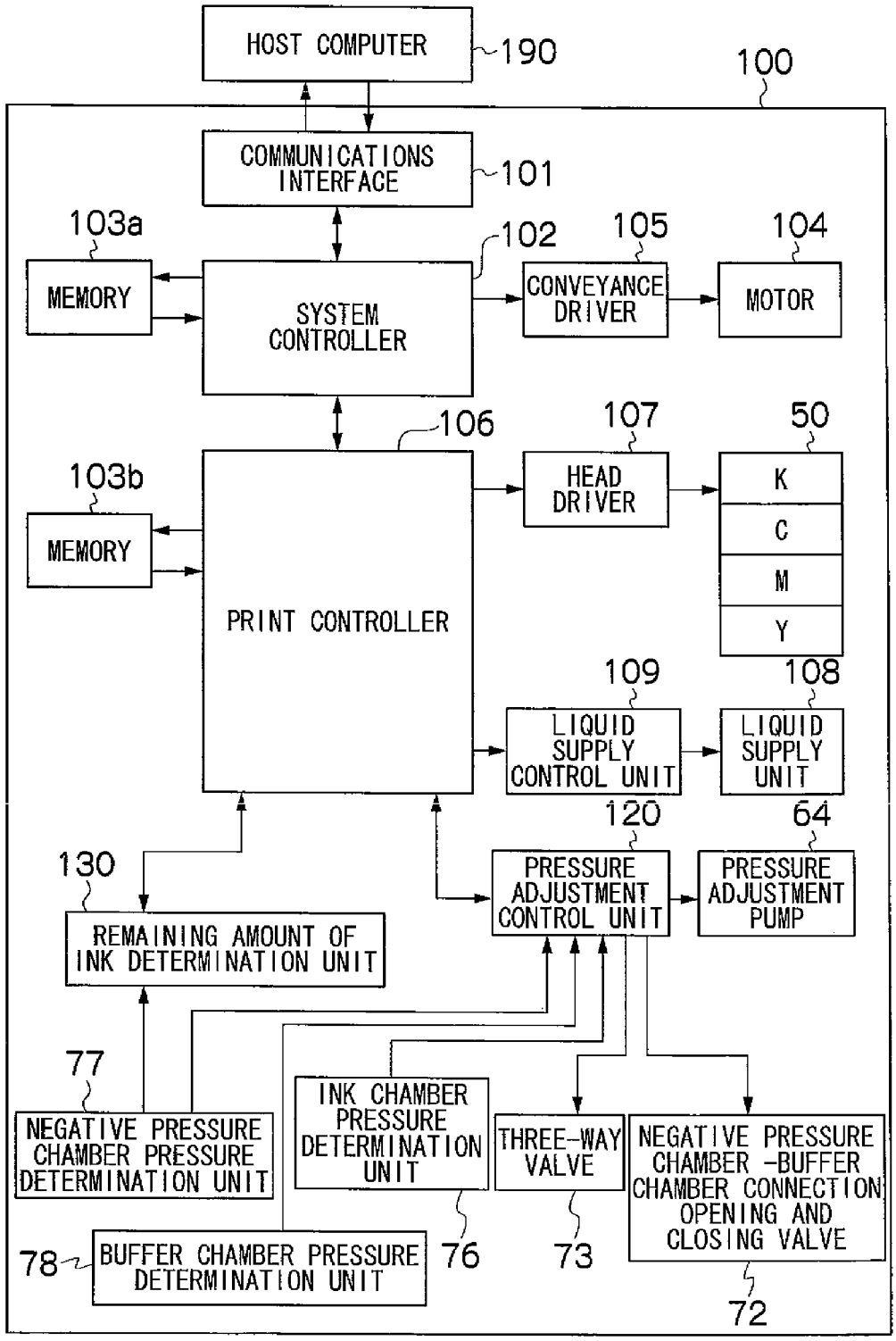
FIG. 4 is a block diagram showing the composition of the control system of the image forming apparatus.

FIG. 4 is a block diagram showing the composition of the control system of the image forming apparatus 100 (liquid droplet ejection apparatus) illustrated in FIG. 1.

In FIG. 4, the image forming apparatus 100 principally comprises a liquid ejection head 50, a pressure adjustment pump 64, a negative pressure chamber-buffer chamber connection opening and closing valve 72, a three-way valve 73, an ink chamber pressure determination unit 76, a negative pressure chamber pressure determination unit 77, a buffer chamber pressure determination unit 78, a communications interface 101, a system controller 102, memories 103*a* and 103*b*, a conveyance motor 104, a conveyance driver 105, a print controller 106, a head driver 107, a liquid supply unit 108, a liquid supply control unit 109, a pressure adjustment control unit 120, and a remaining amount of ink determination unit 130.

The image forming apparatus 100 has a total of four liquid ejection heads 50, one for each color of black (K), cyan (C), magenta (M) and yellow (Y).

The communication interface 101 is an image data input device for receiving image data sent from a host computer 190. It is possible to use a wired or wireless interface for the communications interface 101. The image data acquired by the image forming apparatus 100 via this communications interface 101 is stored temporarily in the first memory 103*a* which is used to store image data.

The system controller 102 is constituted by a microcomputer and peripheral circuits thereof, and the like, and it is a main control device that controls the whole of the image forming apparatus 100 in accordance with a prescribed program. More specifically the system controller 102 controls the various sections, such as the communications interface 101, the conveyance driver 105, the print controller 106 and the like.

The conveyance motor 104 supplies a motive force to the roller and belt, and the like, in order to convey the ejection receiving medium, such as paper. The ejection receiving medium and the liquid ejection heads 50 are moved relatively with respect to each other, by means of this conveyance motor 104. The conveyance driver 105 is a circuit that drives the conveyance motor 104 in accordance with commands from the system controller 102.

As shown in FIG. 1, the liquid supply unit 108 principally comprises the main tank 60, the first liquid supply flow channel 61 leading from the main tank 60 to the sub tank 40, the opening and closing valve 71 for this flow channel 61, the sub tank 40, the second liquid supply flow channel 84 which leads from the sub tank 40 to the liquid ejection head 50, the opening and closing valve 74 for this flow channel 84, and the ink replenishment pump 63.

The liquid supply control unit 109 is constituted by a microcomputer and peripheral circuits of same, and it controls the supply of ink to the liquid ejection head 50, by means of the liquid supply unit 108.

The print controller 106 is constituted by a microcomputer and peripheral circuits thereof, and the like, and generates the dot data (also called "droplet ejection data") necessary in order to form dots on the ejection receiving medium by ejecting liquid droplets from the liquid ejection head 50 onto the ejection receiving medium, on the basis of the image data input to the image forming apparatus 100. More specifically the print controller 106 functions as an image processing device for performing various tasks, compensations, and other types of processing for generating droplet ejection dot data from the image data stored in the first memory 103*a* in accordance with commands from the system controller 102, and supplies the generated dot data to the head driver 107. The print controller 106 is provided with the second memory 103*b*; and dot data, and the like are temporarily stored in the second memory 103*b* when image is processed in the print controller 106. The aspect shown in FIG. 4 is one in which the second memory 103*b* accompanies the print controller 106; however, the first memory 103*a* may also serve as the second memory 103*b*. Also possible is an aspect in which the print controller 106 and the system controller 102 are integrated to form a single processor.

The head driver 107 outputs ejection drive signals to the piezoelectric actuators (58 in FIG. 2B) of the liquid ejection head 50 on the basis of the dot data supplied by the print controller 106 (in practice, the dot data stored in the second memory 103*b*). By supplying the ejection drive signals output from the head driver 107, to the piezoelectric elements 58 of the liquid ejection head 50, liquid (droplets) are ejected from the nozzles 51 of the liquid ejection head 50 toward the ejection receiving medium.

The pressure adjustment control unit 120 is constituted by a microcomputer and peripheral circuits thereof, and this pressure adjustment control unit 120 is connected to the pressure adjustment pump 64, the negative pressure chamber-buffer chamber connection opening and closing valve 72, the three-way valve 73, the ink chamber pressure determination unit 76, the negative pressure chamber pressure determination unit 77, the buffer chamber pressure determination unit 78, and the like. The pressure adjustment control unit 120 adjusts the back pressure of the liquid ejection head 50 in accordance with instructions from the print controller 106.

More specifically, the pressure adjustment control unit 120 controls the pressure adjustment pump 64, the negative pressure chamber-buffer chamber connection opening and closing valve 72 (valve B), the three-way valve 73 (valve C), and the like so that: the negative pressure chamber-buffer chamber connection opening and closing valve 72 (valve B) disconnects the negative pressure chamber 44 of the sub tank 40 from the buffer chamber 65 in FIG. 1, and the three-way valve 73 (valve C) connects the pressure adjustment pump 64 to the negative pressure chamber 44 of the sub tank 40 without though the buffer chamber 65, while the pressure adjustment pump 64 adjusts the pressure of the ink inside the negative pressure chamber 44 of the sub tank 40; the three-way valve 73 (valve C) then disconnects the pressure adjustment pump 64 from the negative pressure chamber 44 of the sub tank 40 and connects the pressure adjustment pump 64 to the buffer chamber 65 while the pressure adjustment pump 64 adjusts the pressure of the gas inside the buffer chamber 65; the negative pressure chamber-buffer chamber connection opening and closing valve 72 (valve B) then connects the negative pressure chamber 44 of the sub tank 40 with the buffer chamber 65, and the three-way valve 73 (valve C) keeps the pressure adjustment pump 64 to be connected to the buffer chamber 65, while the pressure adjustment pump 64 adjusts the pressure of the ink in the ink chamber 43 of the sub tank 40, through the buffer chamber 65. By setting the pressure of the ink inside the ink chamber 43 of the sub tank 40 to a prescribed negative pressure which is lower than the atmospheric pressure in this way, the pressure of the ink inside the common flow channel 55, the pressure chambers 52 and the nozzles 51 of the liquid ejection head 50 shown in FIG. 2B is accordingly set to a prescribed negative pressure which is lower than the atmospheric pressure.

Furthermore, when performing maintenance by suction where ink is suctioned from the nozzle surface 501*a* of the liquid ejection head 50 by means of the suction pump 67 shown in FIG. 3, in a state where the cap 69 shown in FIG. 3 is in contact with the nozzle surface 501*a* of the liquid ejection head 50, the pressure adjustment control unit 120 controls the pressure adjustment pump 64 to adjust the pressure of the ink inside the ink chamber 43 of the sub tank 40, in a state where the connection between the negative pressure chamber 44 of the sub tank 40 and the buffer chamber 65 in FIG. 1 is closed off by the negative pressure chamber-buffer chamber connection opening and closing valve 72 (valve B) and the pressure adjustment pump 64 is connected to the negative pressure chamber 44 of the sub tank 40 in FIG. 1 by means of the three-way valve 73 (valve C), without through the buffer chamber 65.

The remaining amount of ink determination unit 130 is constituted of a microcomputer and a peripheral circuit thereof, and the negative pressure chamber pressure determination unit 77 is connected to this remaining amount of ink determination unit 130. The remaining amount of ink determination unit 130 determines the remaining amount of ink inside the ink chamber 43 of the sub tank 40, by determining the volume of the negative pressure chamber 44 of the sub tank 40 on the basis of the amplitude of the pressure oscillation (i.e., pulsation component in the pressure variation) (which occurs due to the pulsating flow generated by the pressure adjustment pump 64) of the gas inside the negative pressure chamber 44 of the sub tank.

Two typical modes of the remaining amount of ink determination processing carried out by the remaining amount of ink determination unit 130 are described below.

Firstly, there is a remaining amount of ink determination mode in which the remaining amount of ink inside the ink chamber 43 of the sub tank 40 is determined by determining the volume of the negative pressure chamber 44 of the sub tank 40, on the basis of the amplitude of the pressure oscillation (during pressure adjustment without the use of the buffer chamber 65) inside the negative pressure chamber due to the pulsating flow generated by the pressure adjustment pump 64, the amplitude of the pressure oscillation inside the negative pressure chamber 44 being determined by the negative pressure chamber determination unit 77 during pressure adjustment without the use of the buffer chamber 65 (in other words, during pressure adjustment in a state where the pressure adjustment pump 64 is connected directly to the negative pressure chamber 44 of the sub tank 40 in FIG. 1 and the connection between the pressure adjustment pump 64 and the buffer chamber 65 is closed off). Thus, in the first mode of the remaining amount of ink determination processing, the remaining amount of ink is determined on the basis of the volume of the negative pressure chamber 44 that is calculated on the basis of the amplitude of the oscillation of the pressure inside the negative pressure chamber 44 measured by the negative pressure chamber determination unit 77 during pressure adjustment without the use of the buffer chamber 65.

During pressure adjustment without the buffer chamber 65, the oscillation of the gas inside the negative pressure chamber 44 of the sub tank 40 due to the pulsating flow of the pressure adjustment pump 64 has a relatively large amplitude, and therefore it is possible to utilize this amplitude of the pressure oscillation to determine the remaining amount of the ink. For example, the remaining amount of ink is determined by measuring the amplitude of the pressure oscillation, when the back pressure starts to be applied to the liquid ejection head 50, when printing is not being performed, during a pause in ink ejection between pages, or the like.

Secondly, there is a remaining amount of ink determination mode where the remaining amount of liquid inside the ink chamber 43 of the sub tank 40 is determined by determining the volume of the negative pressure chamber 44 of the sub tank 40 on the basis of: the amplitude of the pressure oscillation (during pressure adjustment without the use of the buffer chamber 65) of the gas inside the negative pressure chamber 44 of the sub tank 40; and the amplitude of the pressure oscillation (during pressure adjustment with the use of the buffer chamber 65) of the gas inside the negative pressure chamber 44 of the sub tank 40. In this is case, the amplitude of the pressure oscillation (during pressure adjustment without the use of the buffer chamber 65) is determined by the negative pressure chamber pressure determination unit 77 during pressure adjustment without the use of the buffer chamber 65. The amplitude of the pressure oscillation (during pressure adjustment with the use of the buffer chamber 65) is determined by the negative pressure chamber pressure determination unit 77 during pressure adjustment with the use of the buffer chamber 65 (in other words, during pressure adjustment in a state where the pressure adjustment pump 64 is connected to the buffer chamber 65 and the buffer chamber 65 is connected to the negative pressure chamber 44 of the sub tank 40). Thus, in the second mode of the remaining amount of ink determination processing, the remaining amount of ink is determined on the basis of the volume of the negative pressure chamber 44 that is calculated on the basis of not only the amplitude of the pressure oscillation during pressure adjustment without the use of the buffer chamber 65 but also the amplitude of the pressure oscillation during pressure adjustment with the use of the buffer chamber 65.

The pressure oscillation of the gas inside the negative pressure chamber 44 of the sub tank 40 due to the pulsating flow of the pressure adjustment pump 64 has a relatively small amplitude during pressure adjustment with the use of the buffer chamber 65, while it has a relatively large amplitude during pressure adjustment without the use of the buffer chamber 65. It is therefore possible to determine the remaining amount of ink inside the ink chamber 43 of the sub tank 40 accurately, by utilizing both the amplitude of the pressure oscillation during pressure adjustment without the use of the buffer chamber 65 and the amplitude of the pressure oscillation during pressure adjustment with the use of the buffer chamber 65.

Figure 5:
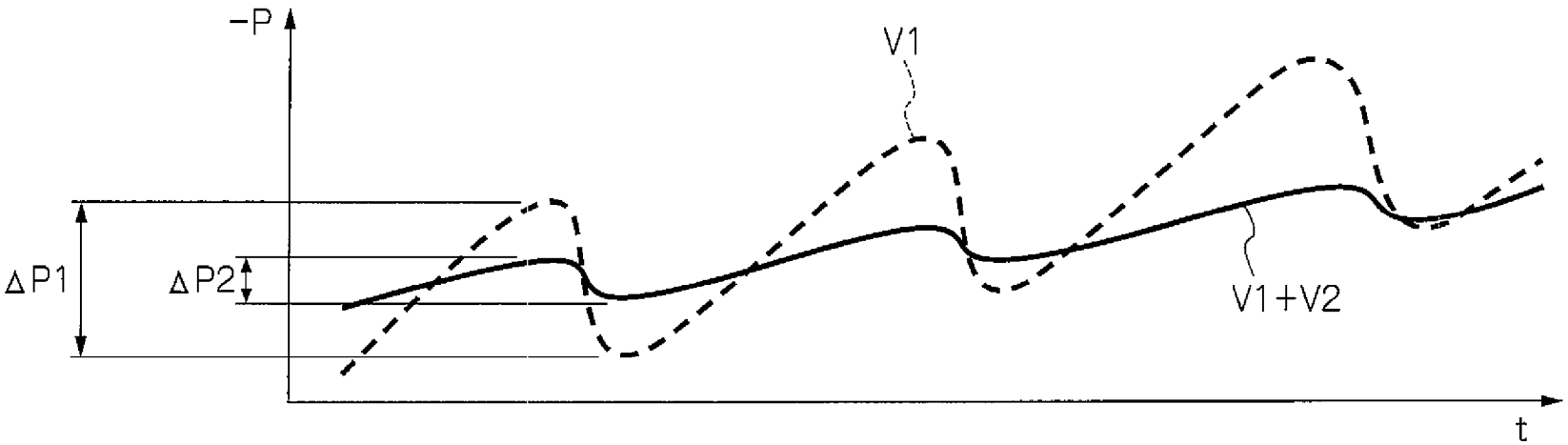
FIG. 5 is an illustrative diagram used to explain the determination of the remaining amount of liquid based on the pressure oscillation due to the pulsating flow.

FIG. 5 is a diagram showing the pressure variation inside the negative pressure chamber 44 of the sub tank 40 during driving of the pressure adjustment pump 64. Here, the horizontal axis represents time t, and the vertical axis represents the pressure P.

In FIG. 5, the dashed line indicates the pressure variation during pressure adjustment without the use of the buffer chamber 65, and the solid line indicates the pressure variation during pressure adjustment with the use of the buffer chamber 65. If the volume of the negative pressure chamber 44 of the sub tank 40 is taken to be V1 and the volume of the buffer chamber 65 is taken to be V2, then during pressure adjustment without the use of the buffer chamber 65, the volume of the hermetically sealed space (from the pressure adjustment pump 65 to the negative pressure chamber 44) approaches "V1", whereas during pressure adjustment with the use of the buffer chamber 65, the volume of the hermetically sealed space (from the pressure adjustment pump 65 to the negative pressure chamber 44) approaches "V1+V2". Therefore, the amplitude ΔP1 of the pressure oscillation due to the pulsating flow during pressure adjustment without the use of the buffer chamber 65 and the amplitude ΔP2 of the pressure oscillation due to the pulsating flow during pressure adjustment with the use of the buffer chamber 65 have a relationship as follows, $$\Delta P1/\Delta P2=(V1+V2)/V1 \quad (1).$$

If the above expression (1) is solved with respect to V1 (the volume of the negative pressure chamber 44 of the sub tank 40), then the following expression is obtained, $$V1=\Delta P2/(\Delta P1-\Delta P2)\times V2 \quad (2).$$

Here, since V2 (the volume of the buffer chamber 65) is uniform, then V1 (the volume of the negative pressure chamber 44 of the sub tank 40) is calculated from the above expression (2), by taking ΔP1 and ΔP2 as variables.

Furthermore, since the volume of the sub tank 40 (in other words, the total volume of the ink chamber 43 plus the negative pressure chamber 44) is uniform, then the volume of the ink chamber 43 of the sub tank 40 (in other words, the remaining amount of ink inside the ink chamber 43 of the sub tank 40) is calculated by subtracting the volume V1 of the negative pressure chamber 44 from the total volume of the sub tank 40.

The first mode and second mode of the remaining amount of ink determination process are described in detail below with reference to a flowchart.

Back Pressure Start-Up Process

Figure 6:
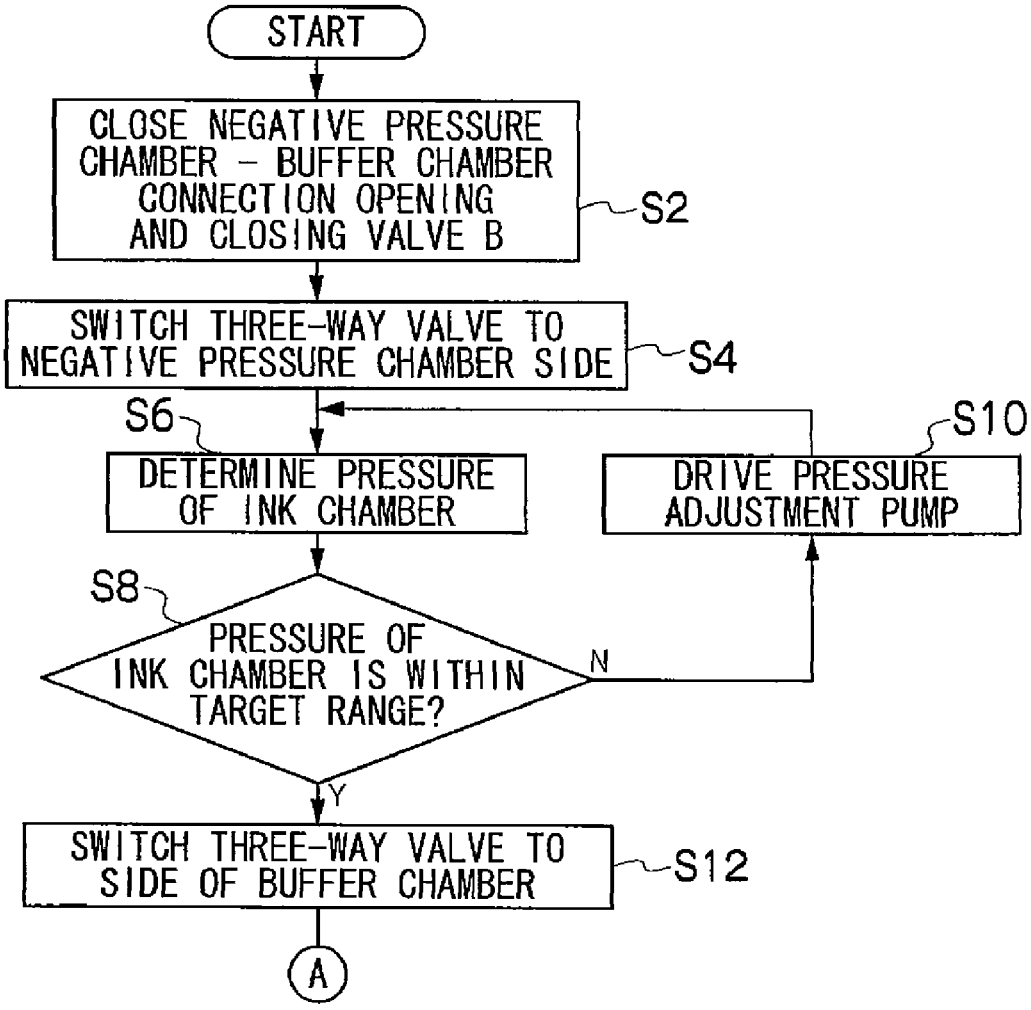
FIG. 6 is a flowchart showing the sequence of one example of a back pressure start-up process.
Figure 6:
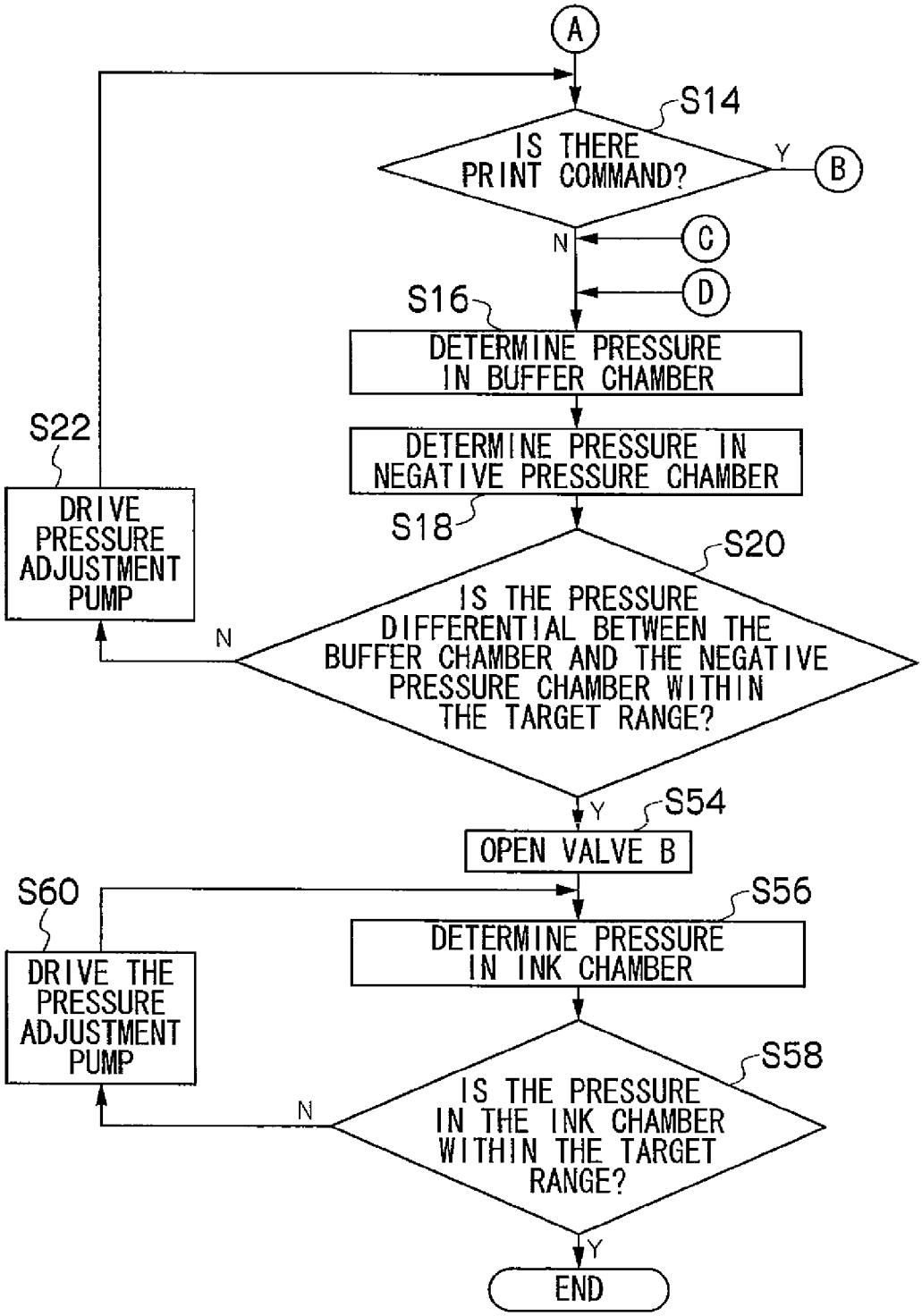
Figure 6:
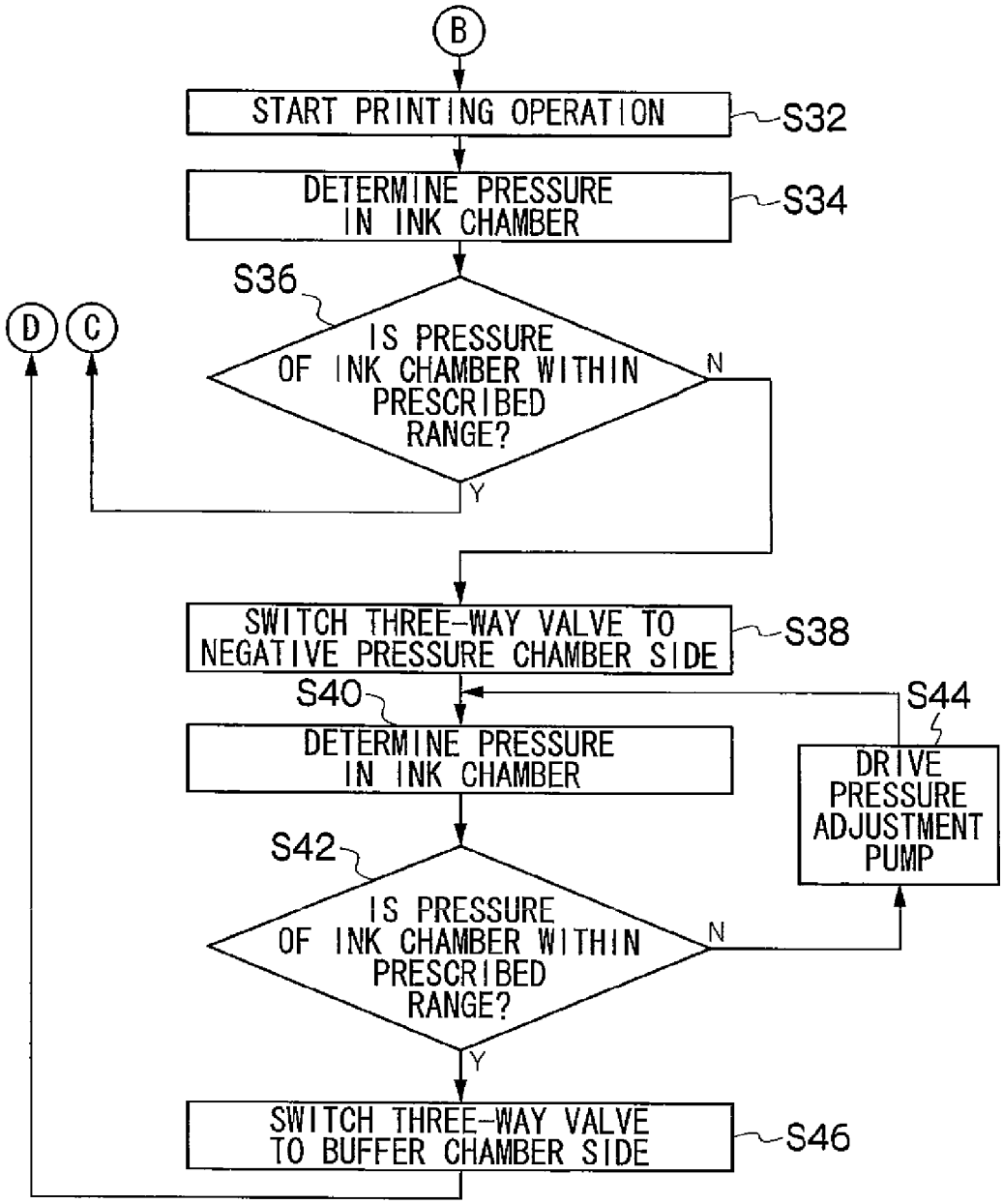

FIG. 6 is a flowchart showing the sequence of one example of a back pressure start-up process in a liquid ejection head 50. This back pressure start-up process is carried out by the pressure adjustment control unit 120 shown in FIG. 4, in accordance with a prescribed program.

In FIG. 6, firstly, the connection between the negative pressure chamber 44 and the buffer chamber 65 of the sub tank 40 is closed off by closing the negative pressure chamber-buffer chamber connection opening and closing valve 72 (valve B) shown in FIG. 1 (S2).

Thereupon, the three-way valve 73 shown in FIG. 1 is switched to the side of the negative pressure chamber 44 of the sub tank 40 (the side of flow channel C) (the flow channel C is opened by means of the three-way valve 73), and the pressure adjustment pump 64 is thereby connected to the negative pressure chamber 44 of the sub tank 40 via the negative pressure chamber-pump connection channel 80C (flow channel C), rather than passing via the buffer chamber 65 (S4).

Thereupon, the pressure of the ink inside the ink chamber 43 of the sub tank 40 is determined by the ink chamber pressure determination unit 76 shown in FIG. 1 (S6), it is judged whether or not the determined pressure is within a target range (S8), and if the pressure is not within the target range, then pressure adjustment of the ink inside the ink chamber 43 of the sub tank 40 is carried out by driving the pressure adjustment pump 64 in FIG. 1 until the pressure comes within the target range (S10).

Since pressure adjustment is carried out in this way without passing via the buffer chamber 65 (without the use of the buffer chamber 65), which has a large volume, then it is possible rapidly to set the ink inside the ink chamber 43 of the sub tank 40 to a target negative pressure which is lower than the atmospheric pressure.

Thereupon, the three-way valve 73 is switched to the side of the buffer chamber 65 (the side of the flow channel A) (the flow channel A is opened by means of the three-way valve 73), in a state where the negative pressure chamber-buffer chamber connection opening and closing valve 72 (valve B) in FIG. 1 is still closed (S12). In other words, the pressure adjustment pump 64 is connected to the buffer chamber 65, in a state where the connection between the negative pressure chamber 44 of the sub tank 40 and the buffer chamber 65 is closed off.

It is judged whether or not there is a print command (S14), and if it is judged that there is no print command, then the pressure of the gas inside the buffer chamber 65 is determined by the buffer chamber pressure determination unit 78 in FIG. 1 (S16), the pressure of the gas inside the negative pressure chamber 44 of the sub tank 40 is determined by the negative pressure chamber pressure determination unit 77 in FIG. 1 (S18), and it is judged whether or not the pressure differential between the pressure of the gas inside the buffer chamber 65 and the pressure of the gas inside the negative pressure chamber 44 of the sub tank 40 is within a target range (S20). If the pressure differential is judged to be not within a target range in the step S20, then the pressure of the gas inside the buffer chamber 65 is adjusted by driving the pressure adjustment pump 64 in FIG. 1 (S22). For example, the pressure of the gas inside the buffer chamber 65 is adjusted in such a manner that it becomes equal to the pressure in the negative pressure chamber 44 of the sub tank 40.

If the pressure differential between the pressure of the gas inside the buffer chamber 65 and the pressure inside the negative pressure chamber 44 of the sub tank 40 is within the target range (for example, if the pressure in the buffer chamber 65 is equal to the pressure in the negative pressure chamber 44), then the negative pressure chamber 44 of the sub tank 40 is connected with the buffer chamber 65 by opening the negative pressure chamber-buffer chamber connection opening and closing valve 72 (valve B) in FIG. 1 (S54). Consequently, the pressure adjustment pump 64 is connected to the negative pressure chamber 44 of the sub tank 40 via the buffer chamber 65, which has a large capacity. The pressure of the ink inside the ink chamber 43 of the sub tank 40 is determined by the ink chamber pressure determination unit 76 shown in FIG. 1 (S56), and it is judged whether or not the determined pressure is within a target range (S58). If the ink pressure is not within the target range, then pressure adjustment of the ink inside the ink chamber 43 of the sub tank 40 is carried out by driving the pressure adjustment pump 64 in FIG. 1 until the pressure comes within the target range (S60). By this means the start-up of The back pressure in the liquid ejection head 50 is completed.

Since the ilk inside the ink chamber 43 of the sub tank 40 in FIG. 1 will already have assumed a prescribed negative pressure by means of steps S6 to S10, then it is also possible to start a printing operation even during pressure adjustment of the gas inside the buffer chamber 65 shown in steps S14 to S22. In other words, at step S14, if it is judged that there is a print command, then a printing operation is started (S32). Since printing can be carried out during adjustment of the pressure in the buffer chamber 65 in this way, then it is possible to shorten the time from the start up of the image forming apparatus 100 until the start of printing.

If printing is started up during pressure adjustment of the buffer chamber 65 (steps S14 to S22), then the pressure of the ink inside the ink chamber 43 of the sub tank 40 is determined by the ink chamber pressure determination unit 76 (S34), it is judged whether or not the determined pressure is within a target range (S36). If the pressure is not within the target range, then the negative pressure chamber 44 of the sub tank 40 is kept to be disconnected from the buffer chamber 65 by closing the negative pressure chamber-buffer chamber connection opening and closing valve 72 (valve B), and the three-way valve 73 is temporarily switched to the negative pressure chamber 44 side (flow channel C side) of the sub tank 40 (the flow channel C is temporarily opened by means of the three-way valve 73) (S38). The pressure adjustment pump 64 is thus connected with the negative pressure chamber 44 of the sub tank 40 through the negative pressure chamber-pump connection channel 80C (flow channel C), without through the buffer chamber 65, and the pressure of the ink inside the ink chamber 43 of the sub tank 40 is adjusted by driving the pressure adjustment pump 64 until the pressure of the ink inside the ink chamber 43 of the sub tank 40 comes within the target range (S40, S42, S44), whereupon the three-way valve 73 is switched to the buffer chamber 65 side (flow channel A side) (the flow channel A is opened by means of the three-way valve 73) (S46).

Here, in order to prevent deterioration of print quality caused by the pulsating flow of the pressure adjustment pump 64, it is desirable that the pressure adjustment pump 64 should be driven only when ejection is not being performed. This reduces the effects of the pulsating flow during pressure adjustment without the use of the buffer chamber 65.

When the pressure of the ink in the ink chamber 43 of the sub tank 40 has come within the target range in this way, then the adjustment of the pressure inside the buffer chamber 65 is restarted (S16 to S22).

Desirably, the opening and closing of the three-way valve 73 or the negative pressure chamber-buffer chamber connection opening and closing valve 72 after the start of a printing operation (more specifically, the switching of the three-way valve 73 in step S38 and the opening of the negative pressure chamber-buffer chamber connection opening and closing valve 72 (valve B) in step S54) is carried out between pages, or when there is no print data and ejection is not being performed. Furthermore, desirably, the driving of the pressure adjustment pump 64 in step S44 after the start of printing should be carried out between pages, or when there is no print data and ejection is not being performed.

Remaining Amount of Ink Determination Process

Figure 7:
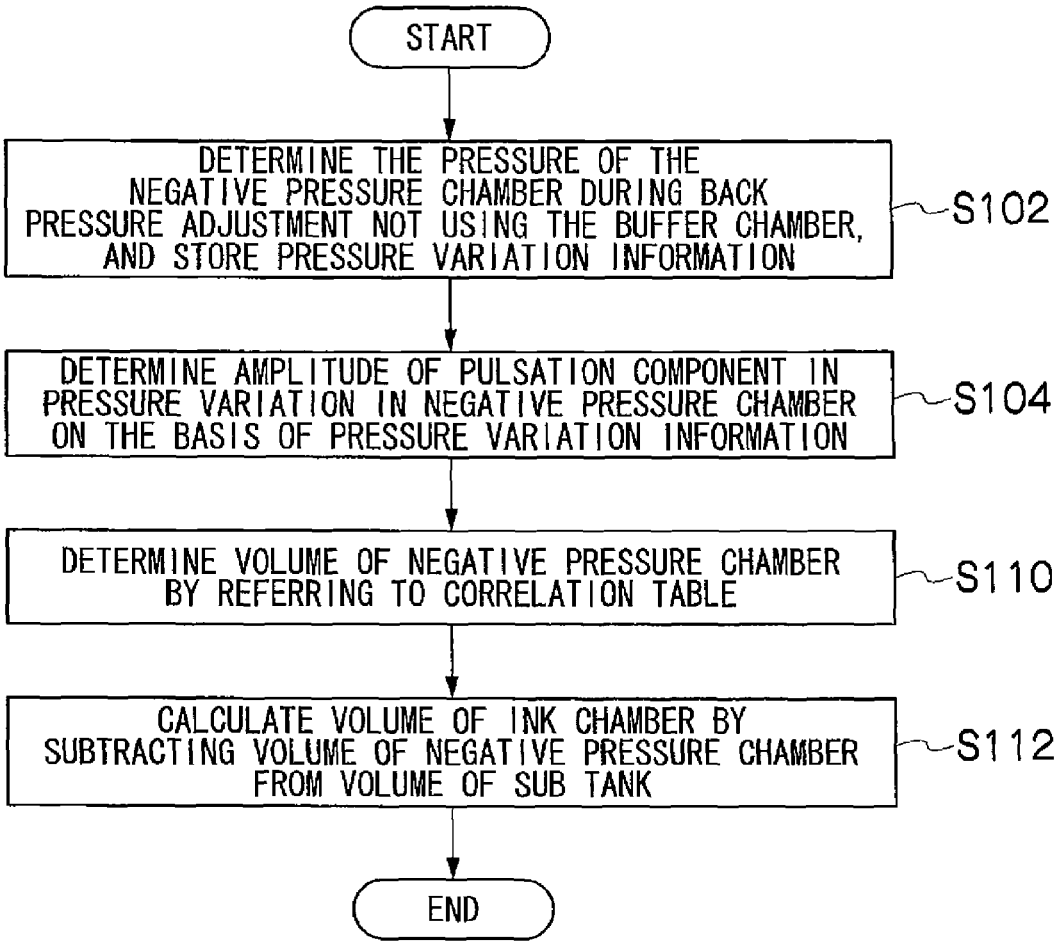
FIG. 7 is a flowchart showing the sequence of a first mode of a remaining amount of ink determination apparatus.

FIG. 7 is a flowchart showing the sequence of one example of a first mode of a remaining amount of ink determination process. This remaining amount of ink determination process is carried out by the remaining amount of ink determination unit 130 shown in FIG. 4, in accordance with a prescribed program.

In FIG. 7, during pressure adjustment (adjustment of the back pressure) without the use of the buffer chamber 65, the pressure of the gas inside the negative pressure chamber 44 of the sub tank 40 is determined by the negative pressure chamber pressure determination unit 77 in FIG. 1, and the determined pressure values are recorded in a time sequence in the memory 103*b* in FIG. 4, as pressure variation information (S102).

Here, the "pressure adjustment without the use of the buffer chamber 65" indicates, for example, the pressure adjustment performed by driving the pressure adjustment pump 64 in steps S10 and S44 in the flowchart in FIG. 6.

In this way, the amplitude (ΔP1 in FIG. 5) of the pressure oscillation due to the pulsating flow which is generated by the pressure adjustment pump 64 and which is propagated into the negative pressure chamber 44 of the sub tank 40 during pressure adjustment without the use of the buffer chamber 65 is determined on the basis of the pressure variation information recorded in the memory 103*b* (S104).

Thereupon, the volume of the negative pressure chamber 44 of the sub tank 40 is determined by referencing a correlation table which indicates the correspondence between the amplitude of the pressure oscillation ΔP1 and the volume of the negative pressure chamber 44 of the sub tank 40 (S110). Here, the correlation table is stored previously in the memory 103*b*.

Figure 9:
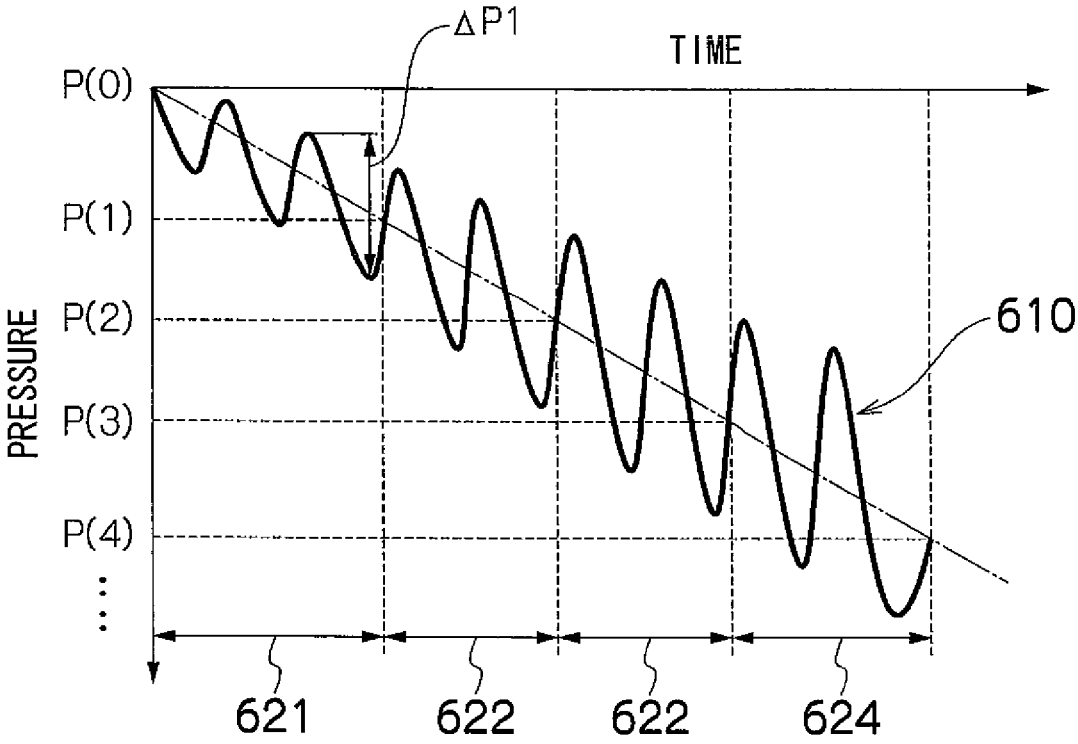
FIG. 9 is a diagram showing one example of the pressure variation measurement data.

FIG. 8 is a diagram showing one example of the correlation table. FIG. 9 is a diagram showing one example of the pressure variation including the pressure oscillation. In the correlation table 600 shown in FIG. 8, the pressure is divided into a plurality of pressure ranges P(0) to P(1), P(1) to P(2), P(2) to P(3), . . . , P(Mmax−1) to P(Mmax), and the values of the amplitude of the pressure oscillation ΔP1 (M, N) which are recorded respectively in association with the volume VN) of the negative pressure chamber 44, for each of the pressure ranges (P(M−1) to P(M)). Here, M and N are integers equal to or greater than 1. Furthermore, P(0) is the atmospheric pressure and P(M) (in other words, the pressures indicated by the symbols P(1) to P(Mmax)) is a negative pressure which is lower than the atmospheric pressure, as shown in FIG. 9. P(Mmax) is also referred to as the "minimum negative pressure", below.

When finding the volume of the negative pressure chamber 44 by referring to the correlation table 600 in FIG. 8, firstly, it is determined which pressure range of the plurality of pressure ranges in the correlation table 600 the pressure determined by the negative pressure chamber pressure determination unit 77 corresponds to, whereupon the volume of the negative pressure chamber 44 corresponding to the amplitude ΔP1 of the pressure oscillation determined at step S104 is determined. In other words, firstly, the value "M" of the pressure range P(M−1) to P(M) is determined, whereupon the value "N" of the amplitude ΔP1 (M, N) of the pressure oscillation is determined, and the volume V(N) of the negative pressure chamber 44 corresponding to this value of ΔP1(M, N) is acquired. Since the volume V(N) of the negative pressure chamber 44 is determined in this way on the basis of the correlation if table 600 in which the amplitude ΔP1 of the pressure oscillation is recorded for each of the plurality of divided pressure ranges, then as shown in FIG. 9, even if the amplitude ΔP1 of the pressure oscillation increases due to the increase in the pressure, the volume V(N) of the negative pressure chamber 44 is still determined accurately on the basis of the amplitude ΔP1 of the pressure oscillation.

Thereupon, the volume of the ink chamber 43 in the sub tank 40 (in other words, the remaining amount of ink in the ink chamber 43) is calculated by subtracting the volume of the negative pressure chamber 44 which has been calculated at step S110 from the volume of the sub tank 40, which is a fixed value (the total volume of the ink chamber 43 and the negative pressure chamber 44) (S112).

Figure 10:
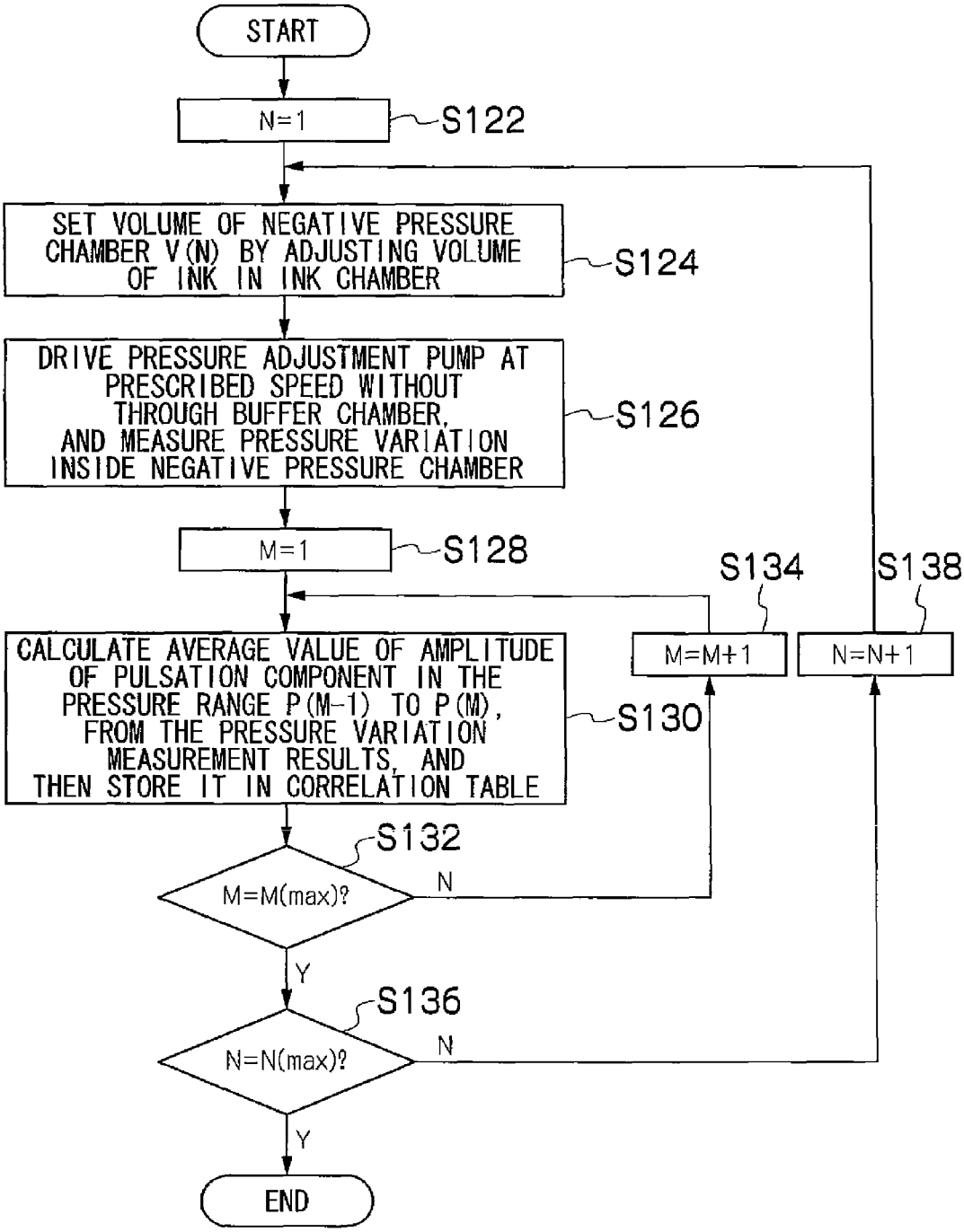
FIG. 10 is a flowchart showing a sequence of one example of a correlation table creation process.

FIG. 10 is a flowchart showing a sequence of one example of a correlation table creation process for creating the correlation table 600 shown in FIG. 8. When the correlation table creation process of this kind is carried out, the ink volume inside the ink chamber 43 of the sub tank 40 is adjusted to an intended amount. For example, the ink is supplied to the ink chamber 43 by means of the ink replenishment pump 63 or the ink is expelled from the ink chamber 43 by previously disconnecting the liquid ejection head 50 from the sub tank 40 and opening the ink chamber-head opening and closing valve 74. When the ink is thus expelled from the ink chamber 43, the expelled ink is collected in a prescribed collection vessel.

In FIG. 10, firstly, the index N(1≦N≦Nmax) of the volume V(N) of the negative pressure chamber 44 of the sub tank 40 is initialized to have a value of "1" (S122). Below, "N" is referred to as the "volume index". Thereupon, the volume V(N) of the negative pressure chamber 44 of the sub tank 40 is set by adjusting the volume of ink in the ink chamber 43 of the sub tank 40 (S124). Thereupon, the pressure adjustment pump 64 is driven at a prescribed speed without through the buffer chamber 65 (without the use of the buffer chamber 65), thereby changing the pressure (negative pressure) of the gas inside the negative pressure chamber 44 of the sub tank 40, and the pressure variation in the negative pressure chamber 44 of the sub tank 40 is measured (S126). More specifically, the pressure of the gas inside the negative pressure chamber 44 of the sub tank 40 gradually declines from the atmospheric pressure P(0) toward the minimum negative pressure P(Mmax) as the pressure adjustment pump 64 is driven without through the buffer chamber 65, and the pressure of the gas inside the negative pressure chamber 44 determined by the negative pressure chamber pressure determination unit 77 is stored as a time series (in chronological order) in a prescribed storage device (for example, the memory 103*b* in FIG. 4), thereby creating the pressure variation measurement data 610 in FIG. 9. Thereupon, the index M of the pressure range of the negative pressure chamber 44 in the sub tank 40 (where 0≦M≦Mmax) is initialized to "1" (S128). Below, "M" is referred to as the "negative pressure index". Next, the average value of the amplitude of the pulsation in the pressure range (P(M−1) to P(M)) is calculated as ΔP1(M, N) from the pressure variation measurement data 610 in FIG. 9 which has been stored at step S126, and this average value is recorded in the correlation table 600 in FIG. 8 (S130). In FIG. 9, the reference numerals 621, 622, 623 and 624 respectively indicate the time period during which the average value ΔP1(1, N) of the amplitude of the pressure oscillation in the first pressure range (P(0) to P(1)) is determined, the time period during which the average value ΔP1(2, N) of the amplitude of the pulsating flow in the second pressure range (P(1) to P(2)) is determined, the time period during which the average value ΔP1 (3, N) of the amplitude of the pulsating flow in the third pressure range (P(2) to P(3)) is determined, and the time period during which the average value ΔP1 (4, N) of the amplitude of the pulsating flow in the fourth pressure range (P(3) to P(4)) is determined. Thereupon, it is judged whether or not the negative pressure index M has reached the maximum value Mmax (S132), and if it has not reached the maximum value Mmax, then the negative pressure index M is increased by 1 (S134), and the step of calculating the average value of the amplitude of the pressure oscillation (S130) is repeated. Thereupon, it is judged whether or not the volume index N has reached the maximum value Nmax (S136), and if it has not reached the maximum value Nmax, then the negative pressure index N is increased by 1 (S138), and the steps S124 to S138 are repeated. When the volume index N has reached the maximum value Nmax at step S136, then the correlation table 600 shown in FIG. 8 is completed and the present process is terminated.

Figure 11:
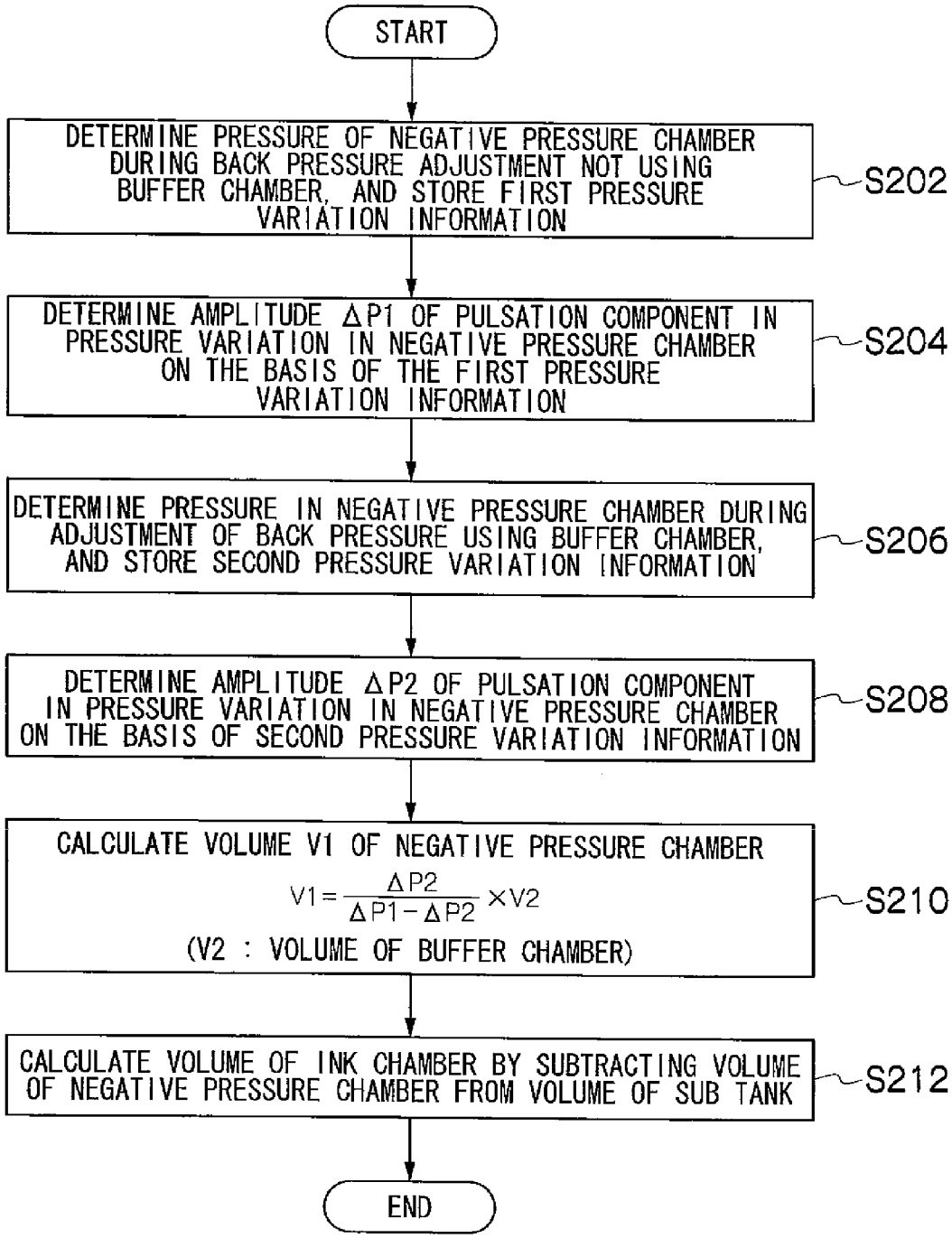
FIG. 11 is a flowchart showing the sequence of a second mode of a remaining amount of ink determination apparatus.

FIG. 11 is a flowchart showing the sequence of one example of a second mode of a remaining amount of ink determination process. This remaining amount of ink determination process is carried out by the remaining amount of ink determination unit 130 shown in FIG. 4, in accordance with a prescribed program.

In FIG. 11, during pressure adjustment without the use of the buffer chamber 65 (hereinafter, referred to as "during first pressure adjustment"), the pressure of the gas in the negative pressure chamber 44 of the sub tank 40 is determined by the negative pressure chamber pressure determination unit 77, and the determined pressure values are recorded in a time sequence (in chronological order) in the memory 103*b* in FIG. 4, as the first pressure variation information (S202).

Here, the "first pressure adjustment" indicates, for example, the pressure adjustment performed by driving the pressure adjustment pump 64 shown in step S10 and step S44 in the flowchart in FIG. 6.

In this way, the amplitude of the pressure oscillation (ΔP1 in FIG. 5) due to the pulsating flow which is generated by the pressure adjustment pump 64 and which is propagated into the negative pressure chamber 44 of the sub tank 40 during the first pressure adjustment is determined on the basis of the first pressure variation information recorded in the memory 103*b* (S204).

Furthermore, during pressure adjustment with the use of the buffer chamber 65 (hereinafter, referred to as "during second pressure adjustment"), the pressure of the gas in the negative pressure chamber 44 of the sub tank 40 is determined by the negative pressure chamber pressure determination unit 77, and the determined pressure values are recorded in a time sequence (in chronological order) in the memory 103*b* in FIG. 4, as the second pressure variation information (S206).

Here, the second pressure adjustment is, for example, the pressure adjustment performed by driving the pressure adjustment pump 64 shown in step S60 in the flowchart in FIG. 6.

It is desirable that the pressure value used when storing the first pressure variation information and the pressure value used when storing the second pressure variation information are substantially the same pressure value.

In this way, the amplitude (ΔP2 in FIG. 5) of the pressure oscillation due to the pulsating flow which is generated by the pressure adjustment pump 64 and which is propagated into the negative pressure chamber 44 of the sub tank 40 during the second pressure adjustment is determined on the basis of the second pressure variation information recorded in the memory 103*b* (S208).

Furthermore, the volume V1 of the negative pressure chamber 44 of the sub tank 40 is calculated by introducing the amplitude ΔP1 of the pressure oscillation during the first pressure adjustment and the amplitude ΔP2 of the pressure oscillation during the second pressure adjustment, into the above-described expression (2) above (S210).

Thereupon, the volume of the ink chamber 43 in the sub tank 40 (in other words, the remaining amount of ink in the ink chamber) is calculated by subtracting the volume V1 of the negative pressure chamber 44 which is calculated at step S210 from the volume of the sub tank 40, which is a fixed value (the total volume of the ink chamber 43 and the negative pressure chamber 44) (S212).

Head Suction Maintenance Process

FIG. 12 is flowchart showing the sequence of one example of a head suction maintenance process for maintaining the suitable state of the ink inside the liquid ejection head 50 by suctioning the ink from the liquid ejection head 50. In this case, the head suctioning maintenance process is carried out on a side of the nozzle surface 501*a* (the liquid ejection surface). The head suction maintenance process is carried out by the liquid supply control unit 109 shown in FIG. 4, in accordance with a prescribed program.

In FIG. 12, firstly, the remaining amount of ink in the ink chamber 43 of the sub tank 40 in FIG. 1 is determined (S302). The remaining amount of ink can be determined by means of the remaining amount of ink determination process shown in FIG. 7 or FIG. 11.

Thereupon, it is judged whether or not the remaining amount of ink inside the ink chamber 43 of the sub tank 40 is equal to or greater than a prescribed maintainable volume, by comparing the determined remaining amount of ink with a prescribed threshold value (S304).

If the remaining amount of ink is less than the threshold value, in other words, if it is judged that the remaining amount of ink is not adequate to carry out the head maintenance, then the ink is supplied from the main tank 60 to the ink chamber 43 of the sub tank 40 by means of the ink replenishment pump 63 in FIG. 1, in such a manner that that the remaining amount of ink inside the ink chamber 43 of the sub tank 40 becomes equal to or greater than a prescribed maintainable amount (S306).

During this replenishment of ink also, the pressure of the ink in the ink chamber 43 of the sub tank 40 is determined, and the pressure of the ink in the ink chamber 43 of the sub tank 40 is adjusted by the pressure adjustment pump 64 in FIG. 1 in such a manner that the pressure comes within the target range.

If it is judged that the remaining amount of ink in the ink chamber 43 of the sub tank 40 is equal to or greater than the prescribed maintainable amount, then the negative pressure chamber-buffer chamber connection opening and closing valve 72 (valve B) in FIG. 1 is closed (S312), and the three-way valve 73 in FIG. 1 is switched to the side of the negative pressure chamber 44 of the sub tank 40 (the flow channel C side) (the flow channel C is opened by means of the three-way valve 73) (S314).

Thereupon, the liquid ejection head 50 is covered with the cap 69 in FIG. 3, and the suction pump 67 in FIG. 3 is driven, whereby suction maintenance of the head is performed (S316).

The pressure of the ink inside the ink chamber 43 of the sub tank 40 is determined by the ink chamber pressure determination unit 76 (S318), it is judged whether or not the determined pressure is within a target range (S320), and the pressure adjustment pump 64 is driven until this pressure comes within the target range (S322).

Thereupon, the driving of the suction pump 67 is halted (S324), and ink is replenished from the main tank 60 to the ink chamber 43 of the sub tank 40 (S326). This ink replenishment step (S326) is the same as the ink replenishment process (S308) which is constituted of the steps S302, S304 and S306, and which has been described already above. Therefore, further explanation thereof is omitted here.

Gas Bubble Removal Process

Figure 13:
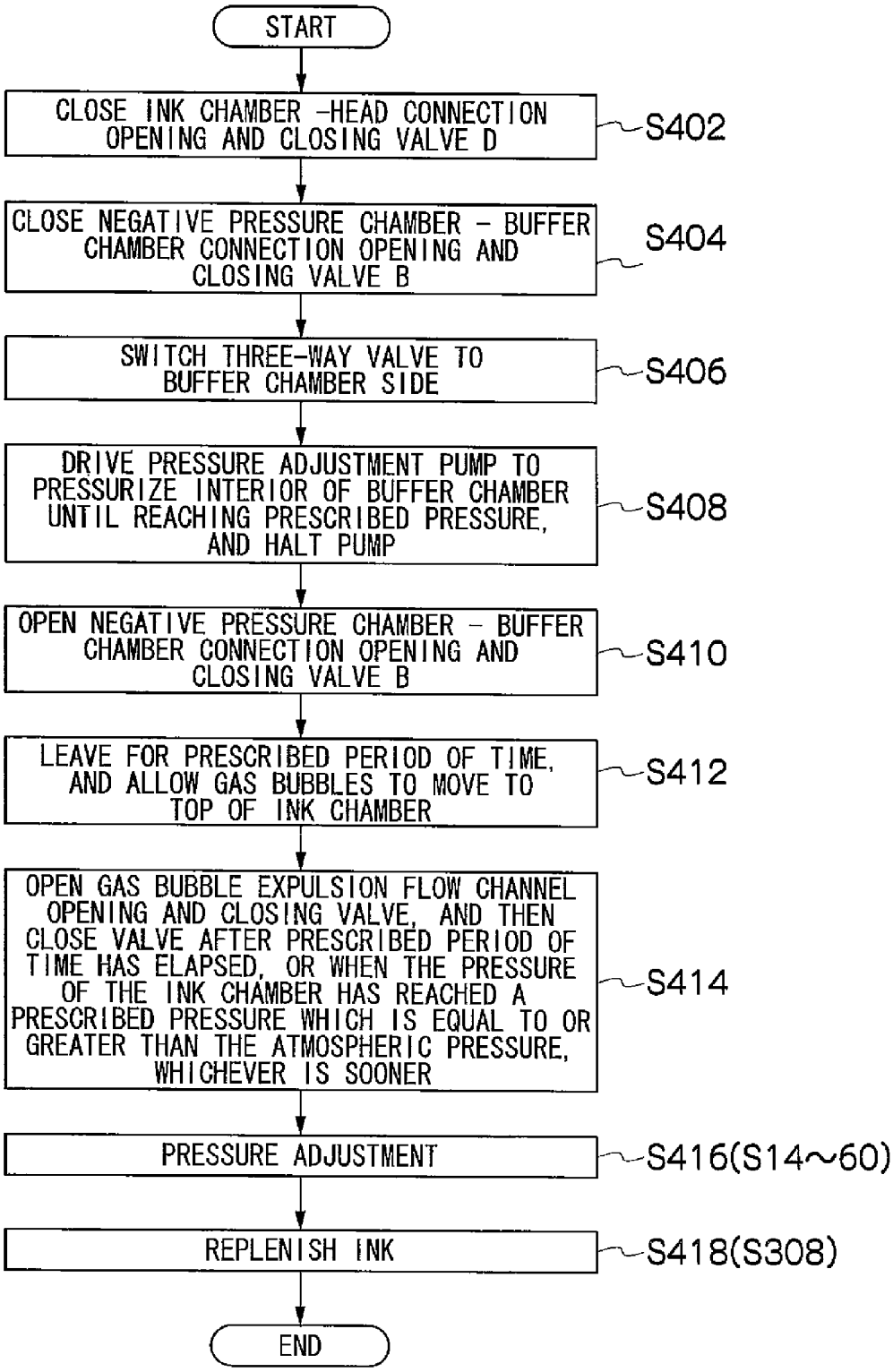
FIG. 13 is a flowchart showing a sequence of one example of a gas bubble removal process.

FIG. 13 is a flowchart showing the sequence of one example of a gas bubble removal process for removing gas bubbles inside the ink chamber 43 of the sub tank 40. This gas bubble removal process is carried out by the liquid supply control unit 109 shown in FIG. 4, in accordance with a prescribed program.

As shown in FIG. 13, the ink chamber-head connection opening and closing valve 74 (valve D) shown in FIG. 1 is closed (S402) in a state where the gas bubble expulsion channel opening and closing valve 75 (valve E) in FIG. 1 is closed, and then the negative pressure chamber-buffer chamber connection opening and closing valve 72 (valve B) in FIG. 1 is closed (S404) and the three-way valve 73 in FIG. 1 is switched to the side of the buffer chamber 65 (the side of flow channel A) (the flow channel A is opened by means of the three-way valve 73) (S406).

Thereupon, the pressure adjustment pump 64 in FIG. 1 is driven, and the pressure inside the buffer chamber 65 is raised until reaching a prescribed pressure, whereupon the pressure adjustment pump 64 is halted (S408) and the negative pressure chamber-buffer chamber connection opening and closing valve 72 (valve B) is opened (S410). By This means, since the pressure of the gas inside the negative pressure chamber 44 changes suddenly, then the gas bubbles adhering to the movable film 42 are detached due to the sudden displacement of the movable film 42 of the sub tank 40 in FIG. 1. Until the gas bubbles move upwards in the ink chamber 43 of the sub tank 40, the system is left for a prescribed time period (S412).

Thereupon, the gas bubble expulsion flow channel opening and closing valve 75 (valve E) is opened, and when a prescribed time period has elapsed, or when the pressure of the ink inside the ink chamber 43 of the sub tank 40 has reached a prescribed pressure (positive pressure) which is not less than atmospheric pressure, whichever is earlier, the gas bubble expulsion flow channel opening and closing valve 75 is closed (S414).

Thereupon, the pressure of the ink chamber 43, and the like, of the sub tank 40 is adjusted (S416). This step is the same as the pressure adjustment process (S14 to S60) from step S14 in FIG. 6 onwards, and since it has already been described above, further explanation thereof is omitted here.

Next, the ink is supplied from the main tank 60 to the ink chamber 43 of the sub tank 40 (S418). This step is the same as the ink replenishment process (S308) which is constituted of the steps S302, S304 and S306 in FIG. 12, and which has been described already above. Therefore, further explanation thereof is omitted here. Here, the ink is supplied by the ink replenishment pump 63 while controlling the pressure in the ink chamber 43 so as to keep the pressure within a target range (S306 in FIG. 12).

The present invention is not limited to the embodiments described above in the present specification or shown in the drawings, and various design modifications and improvements may of course be implemented without departing from the scope of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A pressure adjustment apparatus which adjusts a pressure of liquid inside a liquid ejection head including nozzles and flow channels, the pressure adjustment apparatus comprising:

a tank which includes a movable film and a hermetically sealed container of a prescribed volume, the movable film dividing the hermetically sealed container into a gas chamber filled with gas and a liquid chamber filled with the liquid to be supplied to the liquid ejection head;

a pump which changes a pressure of the gas inside the gas chamber so as to adjust a pressure of the liquid inside the liquid chamber;

a buffer chamber which is filled with the gas and which damps gas-flow pulsations caused by the pump;

a first switching device which connects and disconnects the buffer chamber and the gas chamber; and a second switching device which switches between a state where the pump is connected to the gas chamber without through the buffer chamber, and a state where the pump is connected to the buffer chamber.

2. The pressure adjustment apparatus as defined in claim 1, further comprising a control device which controls the first and second switching devices and the pump, wherein the control device adjusts the pressure of the liquid inside the liquid chamber with the pump in a state where the first switching device disconnects the buffer chamber from the gas chamber and the second switching device connects the pump to the gas chamber without through the buffer chamber, then the control device adjusts a pressure of the gas inside the buffer chamber with the pump in a state where the second switching device connects the pump to the buffer chamber, and then the control device adjusts the pressure of the liquid inside the liquid chamber through the buffer chamber with the pump in a state where the first switching device connects the buffer chamber to the gas chamber and the second switching device connects the pump to the buffer chamber.

3. The pressure adjustment apparatus as defined in claim 2, wherein when suction maintenance for the liquid ejection head is performed to suction the liquid from a liquid ejection surface of the liquid ejection head, the control device adjusts the pressure of the liquid inside the liquid chamber with the pump in the state where the first switching device disconnects the buffer chamber from the gas chamber and the second switching device connects the pump to the gas chamber without through the buffer chamber.

4. The pressure adjustment apparatus as defined in claim 1, further comprising:

a pressure determination device which determines the pressure of the gas inside the gas chamber; and a liquid remaining amount determination device which determines a remaining amount of the liquid inside the liquid chamber by determining a volume of the gas chamber according to an amplitude of pulsation component in a pressure change determined in the pressure of the gas inside the gas chamber by the pressure determination device during pressure adjustment not using the buffer chamber.

5. The pressure adjustment apparatus as defined in claim 1, further comprising:

a pressure determination device which determines the pressure of the gas inside the gas chamber; and a liquid remaining amount determination device which determines a remaining amount of the liquid inside the liquid chamber by determining a volume of the gas chamber according to an amplitude of pulsation component in a pressure change determined in the pressure of the gas inside the gas chamber by the pressure determination device during pressure adjustment not using the buffer chamber, and an amplitude of pulsation component in a pressure change determined in the pressure of the gas inside the gas chamber by the pressure determination device during pressure adjustment using the buffer chamber.

6. An image forming apparatus comprising the pressure adjustment apparatus as defined in claim 1.

* * * * *